US008164528B2

(12) United States Patent
Brown

(10) Patent No.: US 8,164,528 B2
(45) Date of Patent: Apr. 24, 2012

(54) SELF-CONTAINED COUNTERPOISE COMPOUND LOOP ANTENNA

(75) Inventor: Forrest James Brown, Carson City, NV (US)

(73) Assignee: DockOn AG, Zurich (CH)

( * ) Notice: Subject to any disclaimer, the term of this patent is extended or adjusted under 35 U.S.C. 154(b) by 57 days.

(21) Appl. No.: 12/878,020

(22) Filed: Sep. 8, 2010

(65) Prior Publication Data

US 2011/0018777 A1 Jan. 27, 2011

Related U.S. Application Data

(63) Continuation-in-part of application No. 12/921,124, filed as application No. PCT/GB2009/050296 on Mar. 26, 2009.

(60) Provisional application No. 61/303,594, filed on Feb. 11, 2010.

(30) Foreign Application Priority Data

Mar. 26, 2008 (GB) ..... 0805393.6

(51) Int. Cl.
*H01Q 21/00* (2006.01)
*H01Q 11/12* (2006.01)

(52) U.S. Cl. ..... 343/728; 343/744; 343/700 MS

(58) Field of Classification Search ..... 343/700 MS, 343/742, 744, 726, 725, 728, 730, 732, 866, 343/702, 72
See application file for complete search history.

(56) References Cited

U.S. PATENT DOCUMENTS

| | | | | |
|---|---|---|---|---|
| 5,061,938 | A | 10/1991 | Zahn et al. | |
| 5,376,942 | A | 12/1994 | Shiga | |
| 5,751,252 | A | 5/1998 | Phillips | |
| 5,781,159 | A * | 7/1998 | Desargant | 343/700 MS |
| 6,437,750 | B1 | 8/2002 | Grimes et al. | |
| 6,677,901 | B1 | 1/2004 | Nalbandian | |
| 7,215,292 | B2 | 5/2007 | Mclean | |
| 2007/0024514 | A1 * | 2/2007 | Phillips et al. | 343/744 |
| 2007/0080878 | A1 | 4/2007 | McLean | |
| 2007/0182658 | A1 | 8/2007 | Ozden et al. | |
| 2009/0073048 | A1 | 3/2009 | Kim | |
| 2010/0103061 | A1 | 4/2010 | Yung et al. | |

FOREIGN PATENT DOCUMENTS

EP 1672735 A1 6/2006

(Continued)

OTHER PUBLICATIONS

Chan et al., "Printed Antenna Composed of a Bow-tie Dipole and a Loop," IEEE Antennas and Propagation International Symposium 2007, Jun. 2007, pp. 681-684, IEEE, 1-4244-0878-4/07.

(Continued)

*Primary Examiner* — Hoanganh Le
(74) *Attorney, Agent, or Firm* — SilverSky Group, LLC

(57) ABSTRACT

The present invention relates to a self-contained counterpoise compound field antenna. Improvements relate particularly, but not exclusively, to compound loop antennas having coplanar electric field radiators and magnetic loops with electric fields orthogonal to magnetic fields that achieve performance benefits in higher bandwidth (lower Q), greater radiation intensity/power/gain, and greater efficiency. Embodiments of the self-contained antenna include a transition formed on the magnetic loop and having a transition width greater than the width of the magnetic loop. The transition substantially isolates a counterpoise formed on the magnetic loop opposite or adjacent the electric field radiator.

28 Claims, 26 Drawing Sheets

FOREIGN PATENT DOCUMENTS

| | | | |
|---|---|---|---|
| EP | 1684379 | A1 | 7/2006 |
| EP | 1753080 | A1 | 2/2007 |
| EP | 1973192 | A1 | 9/2008 |
| JP | 03-050922 | A | 3/1991 |
| JP | 05-183317 | A | 7/1993 |
| JP | 2003-258546 | A | 9/2003 |
| WO | 00-25385 | A | 5/2000 |
| WO | 2005-062422 | A1 | 7/2005 |

OTHER PUBLICATIONS

Grimes et al., "Bandwidth and Q of Antennas Radiating TE and TM Modes", IEEE Transactions on Electromagnetic Compatibility, vol. 37., No. 2, May 1995.

Grimes et al., "Minimum Q of Electrically Small Antennas: A Critical Review", Microwave and Optical Technology Letters, vol. 28., No. 3, Feb. 5, 2001.

McLean, James S., "A Re-examination of the Fundamental Limits on the Radiation Q of Electrically Small Antennas", IEEE Transactions on Antennas and Propagation, vol. 44, No. 5, May 1996.

Overfelt et al., "A Colocated Magnetic Loop, Electric Dipole Array Antenna (Preliminary Results)", Naval Air Warfare Center Weapons Division, China Lake, CA, Sep. 1994.

H.A. Wheeler, "Small antennas," IEEE Trans. Antennas Propagat., vol. AP-23, No. 4, pp. 462-469, Jul. 1975.

R.C. Hansen, "Fundamental limitations in antennas," Proc. IEEE, vol. 69, No. 2, pp. 170-182, Feb. 1981.

L.J. Chu, "Physical Limitations of Omni-Directional Antennas," J. Appl. Phys., vol. 19, pp. 1163-1175, Dec. 1948.

H.A. Wheeler, "Fundamental Limitations of Small Antennas", Proc. IRE, vol. 35, pp. 1479-1484, Dec. 1947.

R.F. Harrington, "Effect of Antenna Size on Gain, Bandwidth and Efficiency", J. Res. Nat. Bur. Stand., vol. 64D, pp. 1-12, Jan.-Feb. 1960.

R.L. Fante, "Quality factor of general ideal antennas," IEEE Trans. Antennas Propag., vol. AP-17, No. 2, pp. 151-155, Mar. 1969.

D.M. Grimes and C.A. Grimes, "The Complex Poynting Theorem Reactive Power, Radiative Q, and Limitations on Electrically Small Antennas," IEEE, pp. 97-101, 1995.

C.A. Grimes and D.M. Grimes, "The Poynting Theorems and the Potential for Electrically Small Antennas," Proceedings IEEE Aerospace Conference, pp. 161-176, 1997.

F. Tefiku and C.A. Grimes, "Coupling Between Elements of Electrically Small Compound Antennas," Microwave and Optical Technology Letters, vol. 22, No. 1, pp. 16-21, 1999.

McLean, J.S., "The Application of the Method of Moments to Analysis of Electrically Small 'Compound' Antennas," IEEE EMC Symp., pp. 119-124, Aug. 1995.

J.C.-E. Sten and A. Hujanen, "Notes on the quality factor and bandwidth of radiating systems", Electrical Engineering 84, pp. 189-195, 2002.

R.E. Collin and S. Rothschild, "Evaluation of antenna Q," IEEE Trans Antennas Propagat., vol. 44, pp. 23-27, 1964.

A.D. Yaghjian and S.R. Best, "Impedance, bandwidth, and Q of antennas," IEEE Trans. Antennas Propagat., vol. 53, No. 4, pp. 1298-1324, Apr. 2005.

D.K. Cheng, "Optimization techniques for antenna arrays," Proc. IEEE, vol. 59, No. 12, pp. 1664-1674, Dec. 1971.

Yazdanboost, K.Y., Kohno, R., "Ultra wideband L-loop antenna" in Ultra-Wideband, 2005. ICU 2005. 2005 IEEE International Conference on. Issue Date: 5-8 Sep. 2005, pp. 201-205. ISBN: 0-7803-9397-X.

* cited by examiner

XZ PLANE

XY PLANE

XZ PLANE

XY PLANE

YZ PLANE

SELF-CONTAINED COUNTERPOISE COMPOUND LOOP ANTENNA

CROSS-REFERENCES TO RELATED APPLICATIONS

This application is a Continuation in Part of National Stage Ser. No. 12/921,124, filed Sep. 3, 2010, which claims priority to Patent Cooperation Treaty Serial Number PCT/GB2009/050296, filed Mar. 26, 2009, which claims priority to Patent Application Serial Number GB0805393.6, filed Mar. 26, 2008. This application is a non-provisional application taking priority from U.S. Provisional Application No. 61/303,594, filed Feb. 11, 2010.

BRIEF DESCRIPTION OF THE INVENTION

Embodiments of the present invention relate to a self-contained counterpoise compound field antenna. Improvements relate particularly, but not exclusively, to compound loop antennas having coplanar electric field radiators and magnetic loops with electric fields orthogonal to magnetic fields that achieve performance benefits in higher bandwidth (lower Q), greater radiation intensity/power/gain, and greater efficiency. Embodiments of the self-contained antenna include a transition formed on the magnetic loop and having a transition width greater than the width of the magnetic loop. The transition substantially isolates a counterpoise formed on the magnetic loop opposite or adjacent to the electric field radiator.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

The ever decreasing size of modern telecommunication devices creates a need for improved antenna designs. Known antennas in devices such as mobile/cellular telephones provide one of the major limitations in performance and are almost always a compromise in one way or another.

In particular, the efficiency of the antenna can have a major impact on the performance of the device. A more efficient antenna will radiate a higher proportion of the energy fed to it from a transmitter. Likewise, due to the inherent reciprocity of antennas, a more efficient antenna will convert more of a received signal into electrical energy for processing by the receiver.

In order to ensure maximum transfer of energy (in both transmit and receive modes) between a transceiver (a device that operates as both a transmitter and receiver) and an antenna, the impedance of both should match each other in magnitude. Any mismatch between the two will result in sub-optimal performance with, in the transmit case, energy being reflected back from the antenna into the transmitter. When operating as a receiver, the sub-optimal performance of the antenna results in lower received power than would otherwise be possible.

Known simple loop antennas are typically current fed devices, which produce primarily a magnetic (H) field. As such they are not typically suitable as transmitters. This is especially true of small loop antennas (i.e. those smaller than, or having a diameter less than, one wavelength). In contrast, voltage fed antennas, such as dipoles, produce both electric (E) fields and H fields and can be used in both transmit and receive modes.

The amount of energy received by, or transmitted from, a loop antenna is, in part, determined by its area. Typically, each time the area of the loop is halved, the amount of energy which may be received/transmitted is reduced by approximately 3 dB depending on application parameters, such as initial size, frequency, etc. This physical constraint tends to mean that very small loop antennas cannot be used in practice.

Compound antennas are those in which both the transverse magnetic (TM) and transverse electric (TE) modes are excited in order to achieve higher performance benefits such as higher bandwidth (lower Q), greater radiation intensity/power/gain, and greater efficiency.

In the late 1940s, Wheeler and Chu were the first to examine the properties of electrically short (ELS) antennas. Through their work, several numerical formulas were created to describe the limitations of antennas as they decrease in physical size. One of the limitations of ELS antennas mentioned by Wheeler and Chu, which is of particular importance, is that they have large radiation quality factors, Q, in that they store, on time average more energy than they radiate. According to Wheeler and Chu, ELS antennas have high radiation Q, which results in the smallest resistive loss in the antenna or matching network and leads to very low radiation efficiencies, typically between 1-50%. As a result, since the 1940's, it has generally been accepted by the science world that ELS antennas have narrow bandwidths and poor radiation efficiencies. Many of the modern day achievements in wireless communications systems utilizing ELS antennas have come about from rigorous experimentation and optimization of modulation schemes and on air protocols, but the ELS antennas utilized commercially today still reflect the narrow bandwidth, low efficiency attributes that Wheeler and Chu first established.

In the early 1990s, Dale M. Grimes and Craig A. Grimes claimed to have mathematically found certain combinations of TM and TE modes operating together in ELS antennas that exceed the low radiation Q limit established by Wheeler and Chu's theory. Grimes and Grimes describe their work in a journal entitled "Bandwidth and Q of Antennas Radiating TE and TM Modes," published in the IEEE Transactions on Electromagnetic Compatibility in May 1995. These claims sparked much debate and led to the term "compound field antenna" in which both TM and TE modes are excited, as opposed to a "simple field antenna" where either the TM or TE mode is excited alone. The benefits of compound field antennas have been mathematically proven by several well respected RF experts including a group hired by the U.S. Naval Air Warfare Center Weapons Division in which they concluded evidence of radiation Q lower than the Wheeler-Chu limit, increased radiation intensity, directivity (gain), radiated power, and radiated efficiency (P. L. Overfelft, D. R. Bowling, D. J. White, "Colocated Magnetic Loop, Electric Dipole Array Antenna (Preliminary Results)," Interim rept., September 1994).

Compound field antennas have proven to be complex and difficult to physically implement, due to the unwanted effects of element coupling and the related difficulty in designing a low loss passive network to combine the electric and magnetic radiators.

There are a number of examples of two dimensional, non-compound antennas, which generally consist of printed strips of metal on a circuit board. However, these antennas are voltage fed. An example of one such antenna is the planar inverted F antenna (PIFA). The majority of similar antenna designs also primarily consist of quarter wavelength (or some multiple of a quarter wavelength), voltage fed, dipole antennas.

Planar antennas are also known in the art. For example, U.S. Pat. No. 5,061,938, issued to Zahn et al., requires an expensive Teflon substrate, or a similar material, for the antenna to operate. U.S. Pat. No. 5,376,942, issued to Shiga, teaches a planar antenna that can receive, but does not transmit, microwave signals. The Shiga antenna further requires an expensive semiconductor substrate. U.S. Pat. No. 6,677,901, issued to Nalbandian, is concerned with a planar antenna that requires a substrate having a permittivity to permeability ratio of 1:1 to 1:3 and which is only capable of operating in the HF and VHF frequency ranges (3 to 30 MHz and 30 to 300 MHz). While it is known to print some lower frequency devices on an inexpensive glass reinforced epoxy laminate sheet, such as FR-4, which is commonly used for ordinary printed circuit boards, the dielectric losses in FR-4 are considered to be too high and the dielectric constant not sufficiently tightly controlled for such substrates to be used at microwave frequencies. For these reasons, an alumina substrate is more commonly used. In addition, none of these planar antennas are compound loop antennas.

The basis for the increased performance of compound field antennas, in terms of bandwidth, efficiency, gain, and radiation intensity, derives from the effects of energy stored in the near field of an antenna. In RF antenna design, it is desirable to transfer as much of the energy presented to the antenna into radiated power as possible. The energy stored in the antenna's near field has historically been referred to as reactive power and serves to limit the amount of power that can be radiated. When discussing complex power, there exists a real and imaginary (often referred to as a "reactive") portion. Real power leaves the source and never returns, whereas the imaginary or reactive power tends to oscillate about a fixed position (within a half wavelength) of the source and interacts with the source, thereby affecting the antenna's operation. The presence of real power from multiple sources is directly additive, whereas multiple sources of imaginary power can be additive or subtractive (canceling). The benefit of a compound antenna is that it is driven by both TM (electric dipole) and TE (magnetic dipole) sources which allows engineers to create designs utilizing reactive power cancellation that was previously not available in simple field antennas, thereby improving the real power transmission properties of the antenna.

In order to be able to cancel reactive power in a compound antenna, it is necessary for the electric field and the magnetic field to operate orthogonal to each other. While numerous arrangements of the electric field radiator(s), necessary for emitting the electric field, and the magnetic loop, necessary for generating the magnetic field, have been proposed, all such designs have invariably settled upon a three-dimensional antenna. For example, U.S. Pat. No. 7,215,292, issued to McLean, requires a pair of magnetic loops in parallel planes with an electric dipole on a third parallel plane situated between the pair of magnetic loops. U.S. Pat. No. 6,437,750, issued to Grimes et al., requires two pairs of magnetic loops and electric dipoles to be physically arranged orthogonally to one another. U.S. Patent Application US2007/0080878, filed by McLean, teaches an arrangement where the magnetic dipole and the electric dipole are also in orthogonal planes.

DETAILED DESCRIPTION OF THE INVENTION

Embodiments provide an improved planar, compound loop (CPL) antenna, capable of operating in both transmit and receive modes and enabling greater performance than known loop antennas. The two primary components of a CPL antenna are a magnetic loop that generates a magnetic field (H field) and an electric field radiator that emits an electric field (E field).

Figure 1:
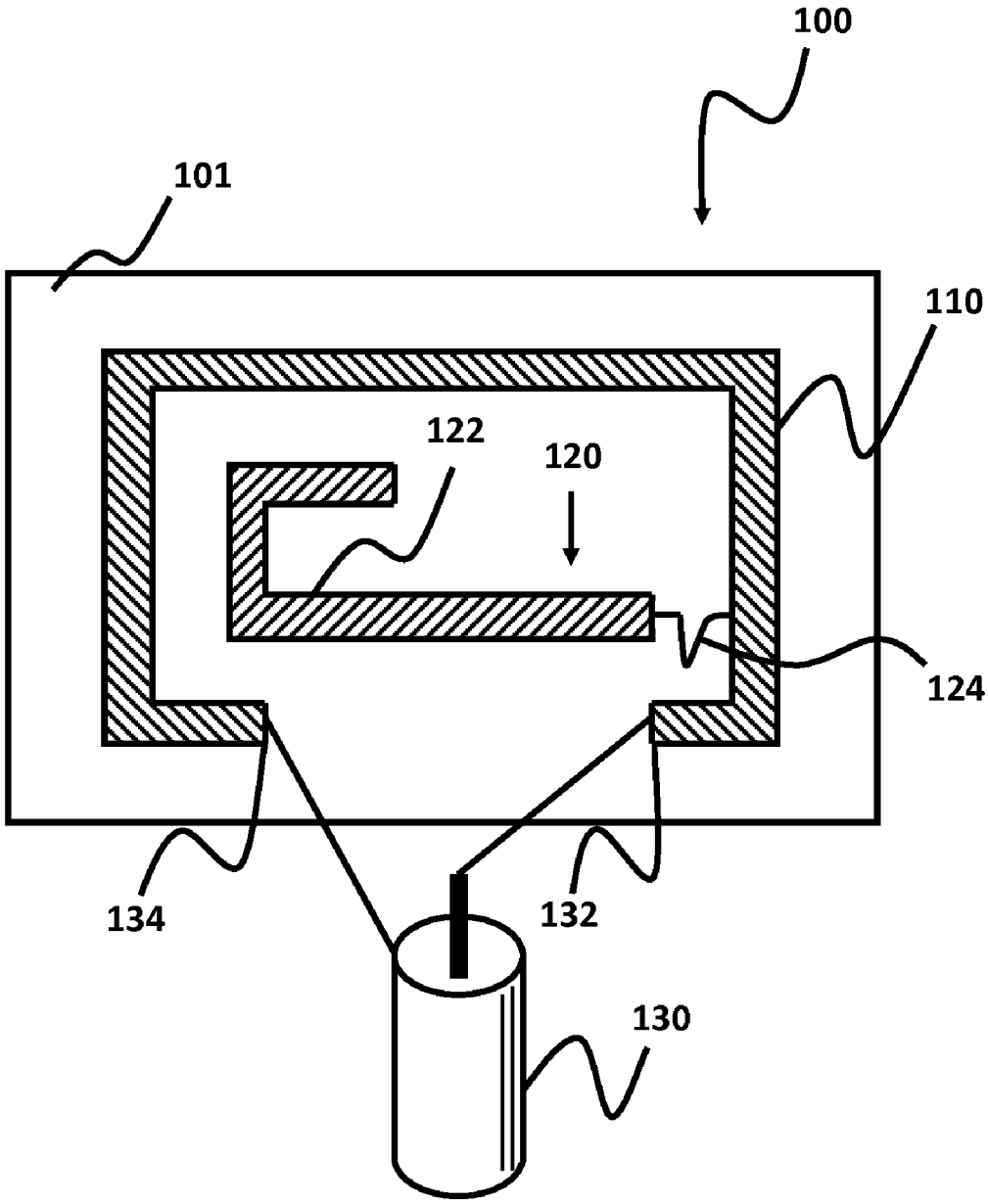
FIG. 1 shows a planar realization of an embodiment of the invention.
Figure 2:
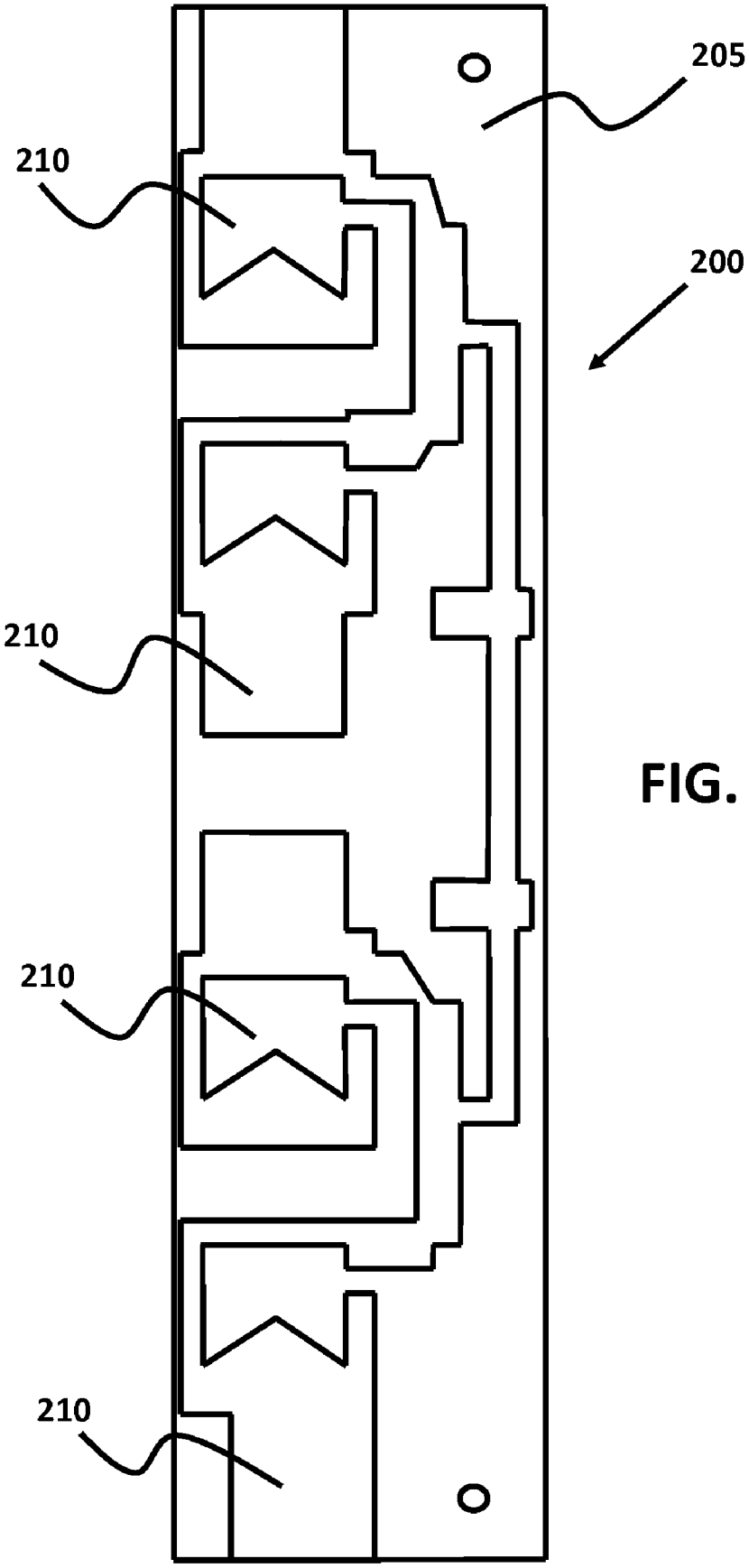
FIG. 2 shows a circuit layout of an embodiment of the present invention incorporating four discrete antenna elements.
Figure 3A:
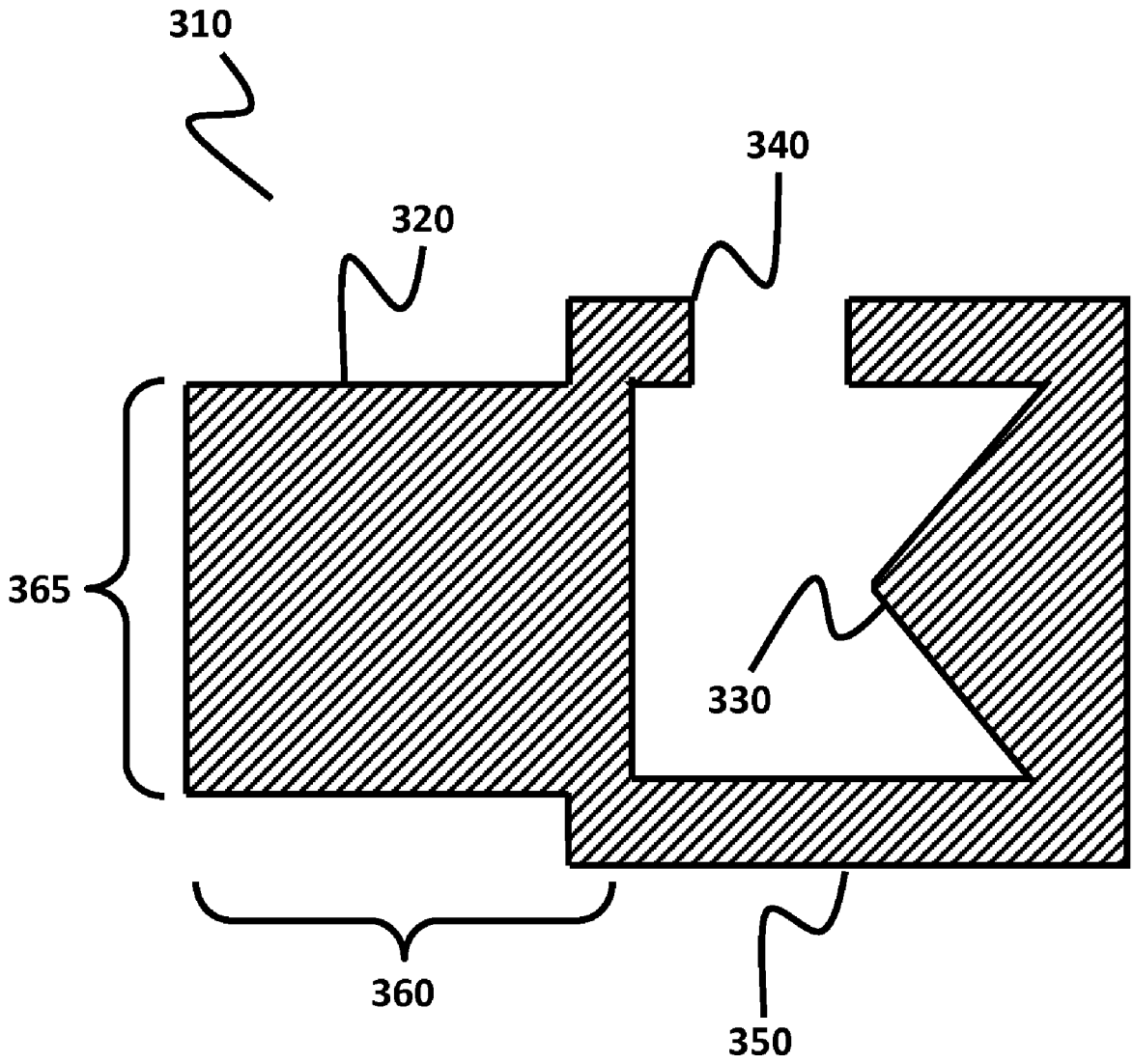
FIG. 3A shows a detailed view of one of the antenna elements of FIG. 2 including a phase tracker.
Figure 3B:
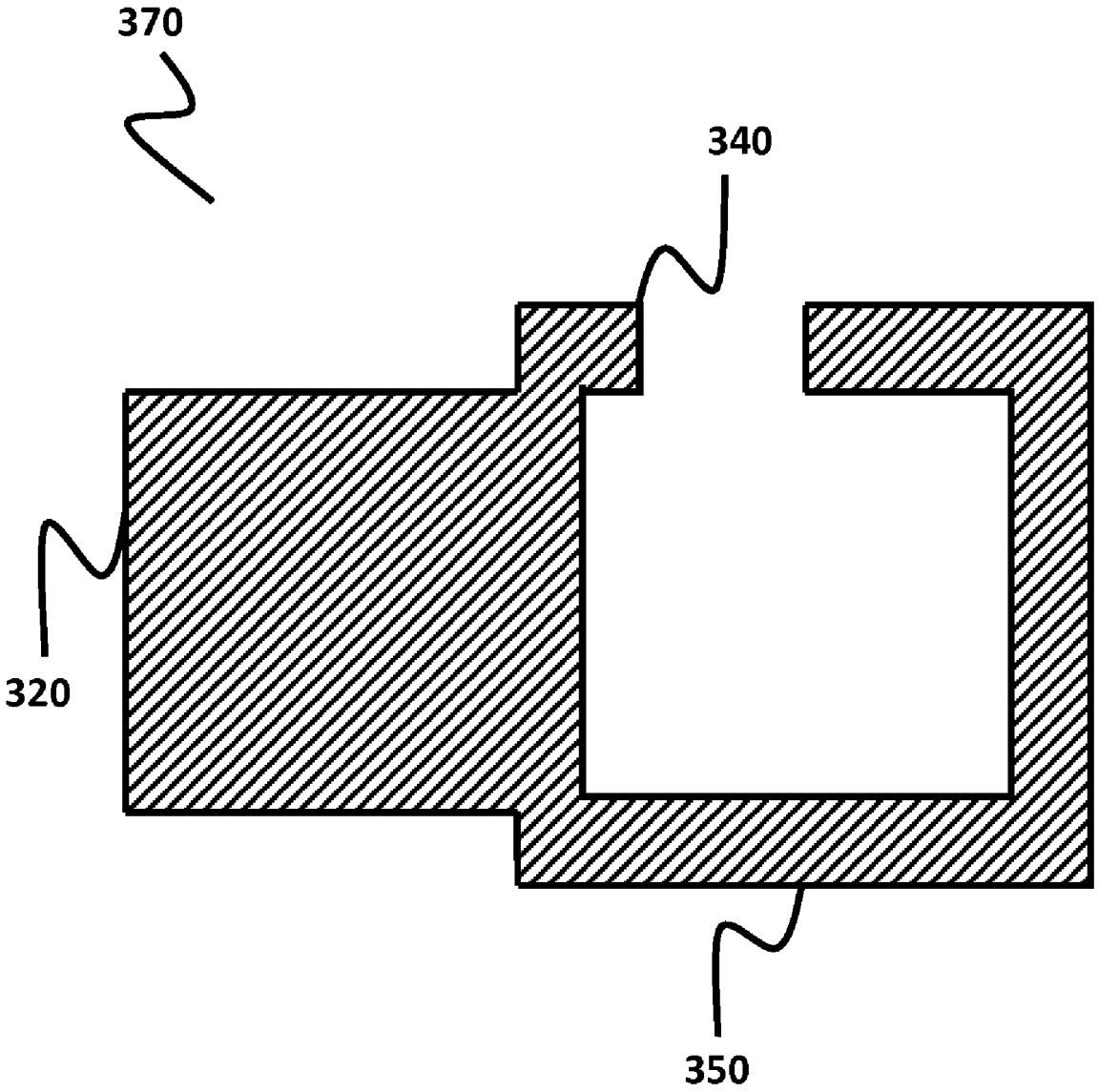
FIG. 3B shows a detailed view of one of the antenna elements of FIG. 2 not including a phase tracker.
Figure 4A:
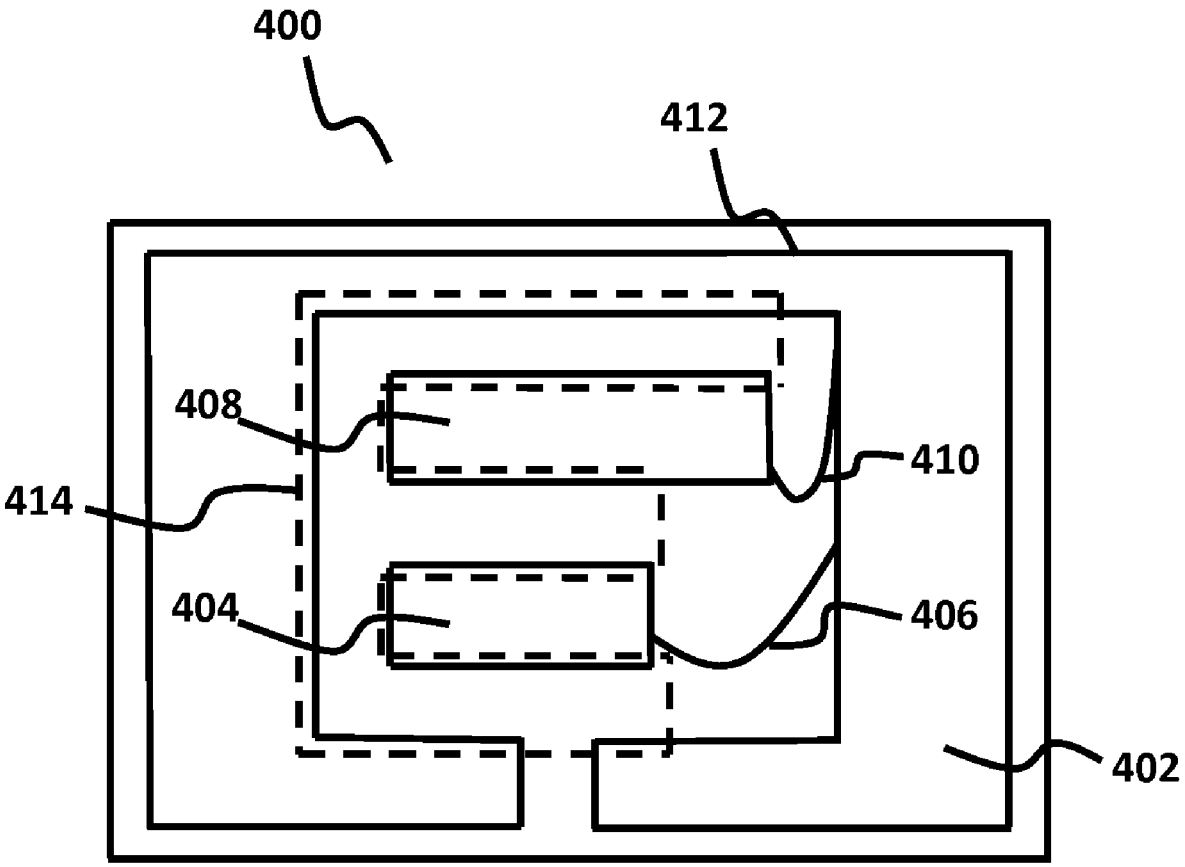
FIG. 4A shows an embodiment of a small, single-sided compound antenna.
Figure 4B:
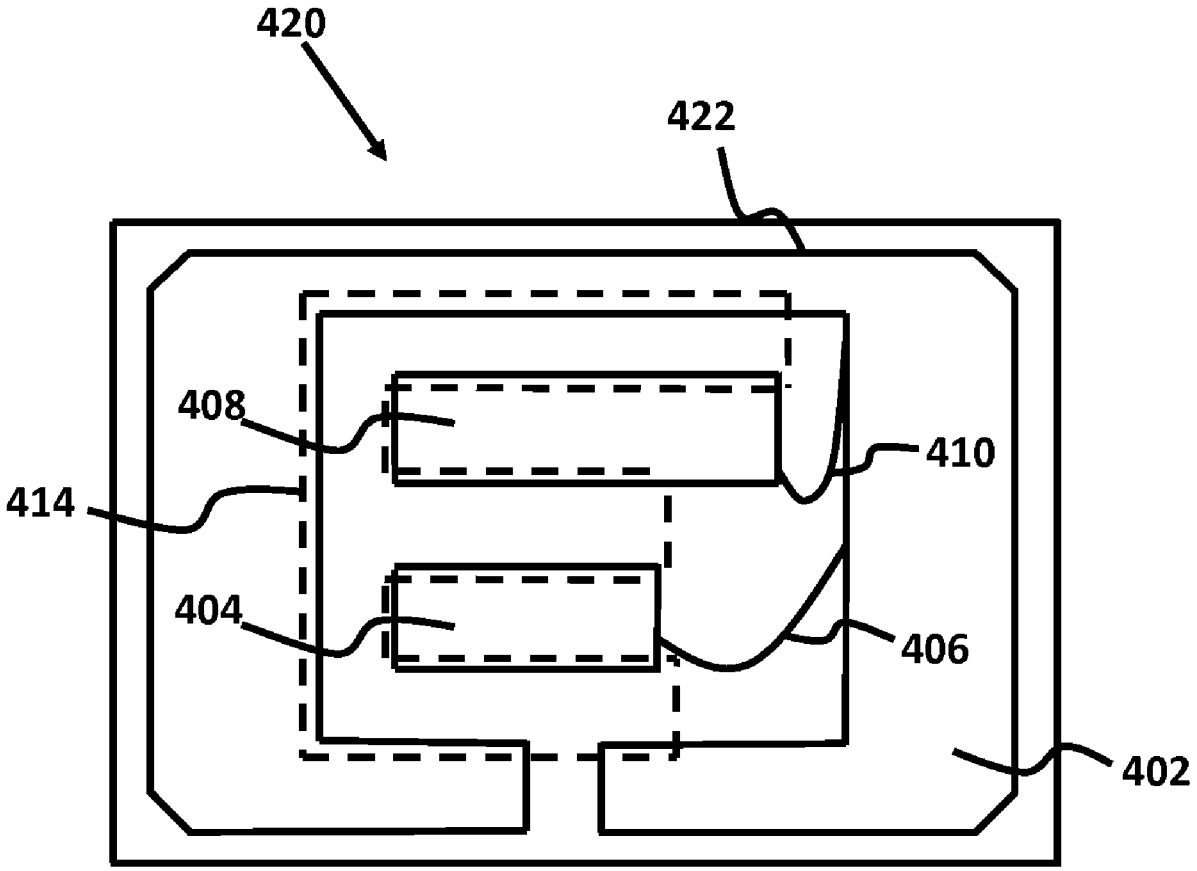
FIG. 4B shows an embodiment of a small, single-sided compound antenna with a magnetic loop whose corners have been cut at an approximately 45 degree angle.
Figure 4C:
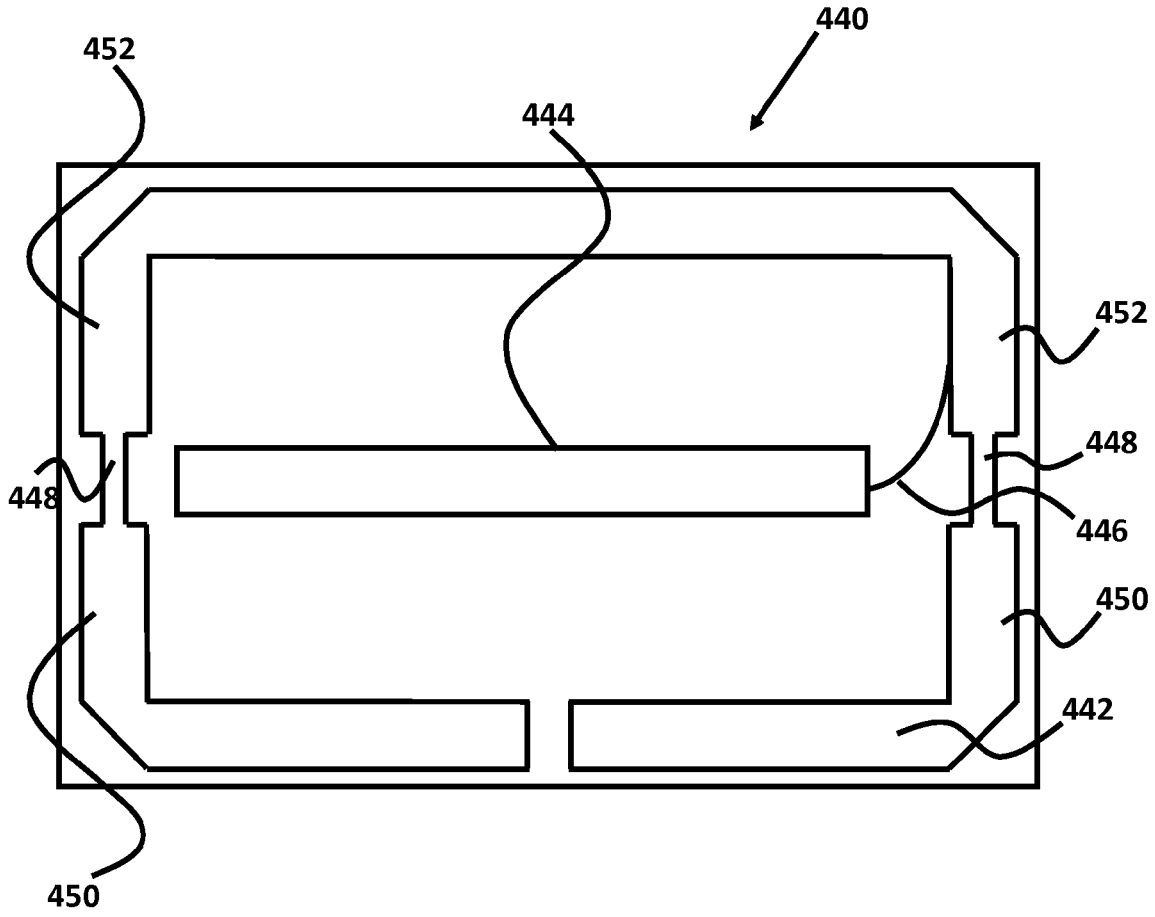
FIG. 4C shows an embodiment of a small, single-sided compound antenna with a magnetic loop having two symmetric wide-narrow-wide transitions.

The electric field radiator may be physically located either inside the loop or outside the loop. For example, FIG. 1 shows an embodiment of a single CPL antenna element with the electric field radiator located on the inside of the loop coupled by an electrical trace, while FIGS. 3A and 3B show two embodiments of a single CPL antenna element with the electric field radiator located on the outside of the loop. FIG. 3A, as further described below, includes a phase tracker for broadband applications, while FIG. 3B does not include the phase tracker and is more suitable for less wideband applications. FIGS. 4A, 4B and 4C illustrate other embodiments of small single-sided antennas where the electric field radiator(s) are located within the magnetic loop. An embodiment of an antenna built using any of these techniques can easily be assembled into a mobile or handheld device, e.g. telephone, PDA, laptop, or assembled as a separate antenna. FIG. 2 and other figures show an embodiment of a CPL antenna array using microstrip construction techniques. Such printing techniques allow a compact and consistent antenna to be designed and built.

The antenna 100 shown in FIG. 1 is arranged and printed on a section of printed circuit board 101. The antenna comprises a magnetic loop 110 which, in this case is essentially rectangular, with a generally open base portion. The two ends of the generally open base portion are fed from a coaxial cable 130 at drive points in a known manner.

Located internally to the loop 110 is an electric field radiator or series resonant circuit 120. The series resonant circuit 120 takes the form of a J-shaped trace 122 on the circuit board 101, which is coupled to the loop 100 by means of a meandering trace 124 that operates as an inductor, meaning it has inductance or inductive reactance. The J-shaped trace 122 has essentially capacitive reactance properties dictated by its dimension and the materials used for the antenna. Trace 122 functions with the meandering trace 124 as a series resonant circuit.

The antenna 100 is presented herein for ease of understanding. An actual embodiment may not physically resemble the antenna shown. In this case, it is shown being fed from a coaxial cable 130, i.e. one end of the loop 132 is connected to the central conductor of the cable 130, while the other end of the loop 134 is connected to the outer sheath of the cable 130. The loop antenna 100 differs from known loop antennas in that the series resonant circuit 120 is coupled to the loop 134 part of the way around the loop's circumference. The location of this coupling plays an important part in the operation of the antenna, as discussed below.

By carefully positioning the series resonant circuit 120 and the meandering trace 124 relative to the magnetic loop 110, the E and H fields generated/received by the antenna 100 can be made to be orthogonal to each other, without having to physically arrange the electric field radiator orthogonal to the magnetic loop 110. This orthogonal relationship has the effect of enabling the electromagnetic waves emitted by the antenna 100 to effectively propagate through space. To achieve this effect, the series resonant circuit 120 and the meandering trace 124 are placed at the approximate 90 degree or the approximate 270 degree electrical position along the magnetic loop 110. In alternative embodiments, the meandering trace 124 can be placed at a point along the magnetic loop 110 where current flowing through the magnetic loop is at a reflective minimum. Thus, the meandering trace 124 may or may not be placed at the approximate 90 or 270 degree electrical points. The point along the magnetic loop 110 where current is at a reflective minimum depends on the geometry of the magnetic loop 110. For example, the point where current is at a reflective minimum may be initially identified as a first area of the magnetic loop. After adding or removing metal to the magnetic loop to achieve impedance matching, the point where current is at a reflective minimum may change from the first area to a second area.

The magnetic loop 110 may be any of a number of different electrical and physical lengths; however, electrical lengths that are multiples of a wavelength, a quarter wavelength, and an eighth wavelength, in relation to the desired frequency band(s), provide for a more efficient operation of the antenna. Adding inductance to the magnetic loop increases the electrical length of the magnetic loop. Adding capacitance to the magnetic loop has the opposite effect, decreasing the electrical length of the magnetic loop.

The orthogonal relationship between the H field and E field can be achieved by placing the series resonant circuit 120 and the meandering trace 124 at a physical position that is either 90 or 270 degrees around the magnetic loop from a drive point, which physical position varies based on the frequency of the signals transmitted/received by the antenna. As noted, this position can be either 90 or 270 degrees from the drive point(s) of the magnetic loop 110, which are determined by the ends 132 and 134, respectively. Hence, if end 132 is connected to the central conductor of the cable 130, the meandering trace 124 could be positioned at the 90 degree point, as shown in FIG. 1, or at the 270 degree point (not shown in FIG. 1).

The orthogonal relationship between the H field and the E field can also be achieved by placing the series resonant circuit 120 and the meandering trace 124 at a physical position around the magnetic loop where current flowing through the magnetic loop is at a reflective minimum. As previously noted, the position where current is at a reflective minimum depends on the geometry of the magnetic loop 110.

By arranging the circuit elements in this manner, such that there is a 90 degree phase relationship between the components, there is created an orthogonal relationship between the E and H fields, which enables the antenna 100 to function more effectively as both a receive and transmit antenna. The H field is generated alone (or essentially alone) by the magnetic loop 110, while the E field is emitted by the series resonant circuit 120, which renders the transmitted energy from the antenna in a form suitable for transmission over far greater distances.

The series resonant circuit 120 comprises inductive (L) component(s) and capacitive (C) component(s), the values of which are chosen to resonate at the frequency of operation of the antenna 100, and such that the inductive reactance matches the capacitive reactance. This is so because resonance occurs most efficiently when the reactance of the capacitive component is equal to the reactance of the inductive component, i.e. when $X_L=X_C$. The values of L and C can thus be chosen to give the desired operating range. Other forms of series resonant circuits using crystal oscillators, for example, can be used to give other operating characteristics. If a crystal oscillator is used, the Q-value of such a circuit is far greater than that of the simple L-C circuit shown, which will consequently limit the bandwidth characteristics of the antenna.

As noted above, the series resonant circuit 120 is effectively operating as an E field radiator (which by virtue of the reciprocity inherent in antennas means it is also an E field receiver). As shown, the series resonant circuit 120 is a quarter wavelength antenna, but the series resonant circuit may also operate as a multiple of a full wavelength, a multiple of a quarter wavelength, or a multiple of an eighth wavelength antenna. If special limitations prohibit the desired wavelength of material being used as trace 122, it is possible to utilize meandering trace 124 as a means to increase propagation delay in order to achieve an electrically equivalent full, quarter or eighth wavelength series resonant circuit 120. It would be possible, in theory, but not generally so in practice, to simply use a rod antenna of the desired wavelength in place of the series resonant circuit, provided it was physically connected to the loop at the 90/270 degree point or the point where current flowing through the magnetic loop is at a reflective minimum, and it complied with the requirement of $X_L=X_C$.

As noted above, the positioning of the series resonant circuit 120 is important: it can be positioned and coupled to the loop at a point where the phase difference between the E and H fields is either 90 or 270 degrees or at the point where current flowing through the magnetic loop is at a reflective minimum. From herein, the point where the series resonant circuit 120 is coupled to the magnetic loop 110 will be referred to as a "connection point," the connection point at the 90 or 270 degree electrical point along the magnetic loop will be referred to as the "90/270 connection point," and the connection point where current is at a reflective minimum will be referred to as the "reflective minimum connection point."

The amount of variation of the location of the connection point depends to some extent on the intended use of the antenna and the magnetic loop geometry. For example, the optimal connection point can be found by comparing the performance of the antenna using the 90/270 connection point versus the performance of the antenna using the reflective minimum connection point. The connection point which yields the highest efficiency for the intended use of the antenna can then be chosen. The 90/270 connection point may not be different than the reflective minimum connection point. For example, an embodiment of an antenna may have current at a reflective minimum at the 90/270 degree point or close to the 90/270 degree point. If using the 90/270 degree connection point, the amount of variation from a precise 90/270 degrees depends to some extent on the intended use of the antenna, but in general, the closer to 90/270 degrees it is placed, the better the performance of the antenna. The magnitude of the E and H fields should also, ideally, be identical or substantially similar.

In practice, the point at which the series resonant element 120 is coupled to the loop 110 can be found empirically through use of E and H field probes which define the 90/270 degree position or the point where current is at a reflective minimum. The point where the meandering trace 124 should be coupled to the loop 110 can be determined by moving the trace 124 until the desired 90/270 degree difference is observed. Another method for determining the 90/270 connection point and the reflective minimum connection point along the loop 110 is to visualize surface currents in an electromagnetic software simulation program, in which the best connection point along the loop 110 will be visualized as an area(s) of minimum surface current magnitude(s).

Thus, a degree of empirical measurement and trial and error is required to ensure optimum performance of the antenna, even though the principles underlying the arrangement of the elements are well understood. This is simply due to the nature of printed circuits, which often require a degree of 'tuning' before the desired performance is achieved.

Known simple loop antennas offer a very wide bandwidth, typically one octave, whereas known antennas such as dipoles have a much narrower bandwidth—typically a much smaller fraction of the operating frequency (such as 20% of the center frequency of operation).

Printed circuit techniques are well known and are not discussed in detail here. It is sufficient to say that copper traces are arranged and printed (normally via etching or laser trimming) on a suitable substrate having a particular dielectric effect. By careful selection of materials and dimensions, particular values of capacitance and inductance can be achieved without the need for separate discrete components. As will be further described below, however, the designs of the present embodiments mitigate substrate limitations of prior higher frequency planar antennas.

As noted, the present embodiments are arranged and manufactured using known microstrip techniques where the final design is arrived at as a result of a certain amount of manual calibration whereby the physical traces on the substrate are adjusted. In practice, calibrated capacitance sticks are used which comprise metallic elements having known capacitance elements, e.g., 2 picoFarads. A capacitance stick, for example, may be placed in contact with various portions of the antenna trace while the performance of the antenna is measured.

In the hands of a skilled technician or designer, this technique reveals where the traces making up the antenna should be adjusted in size, equivalent to adjusting the capacitance and/or inductance. After a number of iterations, an antenna having the desired performance can be achieved.

The point of connection between the series resonant element and the loop is again determined empirically using E and H field probes. Once the approximate connection position has been determined, bearing in mind that at the frequency discussed here, the slightest interference from test equipment can have a large practical effect, fine adjustments can be made to the connection and/or the values of L and C by laser-trimming the traces in-situ. Once a final design is established, it can be reproduced with good repeatability. Alternatively, the point of connection between the series resonant element and the loop can be determined using an electromagnetic software simulation program to visualize surface currents, and choosing an area or areas where surface current is at a minimum.

An antenna built according to the embodiments discussed herein offers substantial efficiency gains over known antennas of a similar volume.

In a further embodiment, a plurality of discrete antenna elements can be combined to offer a greater performance than can be achieved by use of a single element.

FIG. 2 shows an antenna 200, arranged and printed on a section of circuit board 205 in a known way. Although the circuit board 205 is illustrated in plan view, there is a certain amount of thickness to the substrate making up the circuit board and a ground plane (not shown) is printed on the back of the circuit board 205, in a manner similar to the ground plane area 624 illustrated in FIGS. 6 and 8. In FIG. 2, the antenna 200 comprises four separate, functionally identical antenna elements 210 that are arranged as two sets, with each set driven in parallel.

The effect of providing multiple instances of the basic antenna element 210 is to improve the overall performance of the antenna 200. In the absence of losses associated with the construction of the antenna, it would, in theory, be possible to construct an antenna comprising a great many individual instances of basic antenna elements 210, with each doubling of the number of elements adding 3 dB of gain to the antenna. In practice, however, losses—particularly dielectric heating effects—mean that it is not possible to add extra elements indefinitely. The example shown in FIG. 2 of a four-element antenna is well within the range of what is physically possible and adds 6 dB (less any dielectric heating losses) of gain over an antenna consisting of a single element.

The antenna 200 of FIG. 2 is suitable for use in a micro-cellular base-station or other item of fixed wireless infrastructure, whereas a single element 210 is suitable for use in a mobile device, such as a cellular or mobile handset, pager, PDA or laptop computer. The only real determining issue is size. The components and operation of the elements 210 are further explained and illustrated in FIGS. 3A and 3B with respect to antennas 310 and 370, respectively.

FIG. 3A illustrates a single antenna 310 (an embodiment of one of the elements 210 of FIG. 2) that can achieve greater bandwidth, of up to one and one-half octaves, as described below, through the inclusion of the phase tracking antenna element 330, which has been specifically adapted to provide a greater operational bandwidth (a wider bandwidth) than the narrower bandwidth antenna 100 of FIG. 1. This wider bandwidth is achieved, in particular, by the combination of the phase tracker 330 with the rectangular electric field radiator 320 and a loop element 350. The rectangular electric field radiator 320 replaces the series resonant circuit 120 shown in FIG. 1. However, the operating bandwidth of the rectangular electric field radiator 320 is wider than that of the tuned circuit 120 due to the operation of the phase tracker 330, as further explained below.

An alternative embodiment to antenna 310 is illustrated in FIG. 3B as antenna 370, which has the same rectangular electric field radiator 320, loop element 350, and drive or feed point 340 as antenna 310 of FIG. 3A, but lacks the phase tracker 330 and therefore has a narrower bandwidth of operation than antenna 310. Another method for incorporating wide bandwidth operation is depicted by the CPL antenna element in FIG. 4A, which incorporates multiple electric field radiators 404 and 408, as further described below.

In the case of the tuned circuit 120, the connection point between the tuned circuit and the loop was important in determining the overall performance of the antenna 100. In the case of the electric field radiator 320 in antennas 310 and 370 from FIGS. 3A and 3B, located on the outside of the loop 350, the precise location is less important because the connection point is effectively distributed along the length of one side of the electric field radiator, although it still generally is arranged at a midpoint of 90/270 degrees around the loop 350 at a center frequency or at a point where current is at a reflective minimum. As such, the end points where the edges of the electric field radiator 320 meet the loop 350, together with the dimensions of the loop, determine the operating frequency range of the antennas 310 and 370.

The dimensions of the loop 350 are also important in determining the operating frequency of the antennas 310 and 370. In particular, the overall length of the loop 350 is a key dimension, as mentioned previously. In order to allow for a wider operating frequency range, the triangular phase tracker element 330 is provided directly opposite the electric field radiator 320 (in one of two possible locations as shown in FIG. 2). The phase tracker 330 effectively acts as an automatic, variable length tracking device, which lengthens or shortens the electrical length of the loop 350, depending on the frequency of RF signal fed into it at a feed or drive point 340.

The phase tracker 330 is equivalent to a near-infinite series of L-C components, only some of which will resonate at a given frequency, thereby automatically altering the effective length of the loop. In this way, a wider bandwidth of operation can be achieved than with a simple loop having no such phase tracking component.

The phase trackers 330, shown in FIG. 2, have two different possible positions. These positions are chosen, for each antenna element 210 in the group of antenna elements 210 shown in FIG. 2, to minimize mutual interference between adjacent antenna elements 210. From an electrical perspective, the two configurations are functionally identical.

The greater bandwidth (up to 1½ octaves) of the antennas 310 and 370 is possible because the magnetic loop 350 is a complete short of the signal current. As illustrated in FIGS. 3A and 3B, the magnetic loop is a complete short because it is a one half wave short, but it could also be a complete short at one quarter wave open and a full wave short. The phase of the antenna is determined by the dimension 360. Dimension 360 spans the length of the electric field radiator 320 and the length of the left side of the magnetic loop 350. The signal is shorted at the point where the signal is 180 degrees out of phase. The magnetic field with greatest magnitude is generated by the magnetic loop, and there is a smaller magnitude magnetic field generated by the electric field radiator. Again, the magnetic loop may vary in length from a RF short with very low real impedance to a near RF open with very high real impedance. The highest magnitude electric field is emitted by one or more electric field radiator elements. However, the magnetic loop also produces a small electric field that is lower in magnitude, and opposite of the magnetic field, than the electric field emitted by the electric field radiators.

The efficiency of the antenna is achieved by maximizing the current in the magnetic loop so as to generate the highest possible H field. This is achieved by designing the antenna such that current moves into the E field radiator and is reflected back in the opposite direction, as further described below in FIG. 6. The maximized H field projects from the antenna in all directions, which maximizes the efficiency of the antenna because more current is available for transmission purposes. The maximum H field energy that can be generated occurs when the magnetic loop is a perfect RF short or when the magnetic loop has very low real impedance. Under normal circumstances, however, an RF short is not desirable because it will burn out the transmitter driving the antenna. A transmitter puts out a set amount of energy at a set impedance. By utilizing impedance matching properties of the electric field it is possible to have a near RF short loop without burning out the transmitter.

A current flowing through the magnetic loop flows into the electric field radiator. The current is then reflected back along an opposite direction into the magnetic loop by the electric field radiator, resulting in the electric field reflecting into the magnetic field to create a short of the electric field radiator and create orthogonal electric and magnetic fields.

Dimension 365 consists of the width of the electric field radiator 320. The dimension 365 does not affect the efficiency of the antenna, but its width determines whether the antenna is narrowband or wideband. The dimension 365 only has a greater width to widen the band of the antenna 310 illustrated in FIG. 3A.

All of the trace elements of the magnetic loop illustrated in FIG. 3A, for example, can be made very thick without affecting the performance or efficiency of the antenna. Making these loop element traces thicker, however, makes it possible to accept greater input power and to otherwise modify the physical size of the antenna to fit a desired space, such as may be required by many different portable devices, such a mobile phones, that operate within specific frequency ranges.

It will be clear to the skilled person that any form of E field radiator may be used in the multiple element configurations shown in FIGS. 2, 3A and 3B, with the rectangular electric field radiator 320 merely being an example. Likewise, a single element embodiment may use a rectangular electric field radiator, a tuned circuit or any other suitable form of antenna. The multiple element version shown in FIG. 2 uses four discrete elements 210, but this can be varied up or down depending on the exact system requirements and the space available, as will be explained, with some limitations on the upper range of elements 210.

Embodiments of the present invention allow for the use of either a single or multi-element antenna, operable over a much increased bandwidth and having superior performance characteristics, compared to similarly-sized known antennas. Furthermore, no complex components are required, resulting in low-cost devices applicable to a wide range of RF devices. Embodiments of the invention find particular use in mobile telecommunication devices, but can be used in any device where an efficient antenna is desired.

An embodiment consists of a small, single-sided compound antenna ("single-sided antenna" or "printed antenna"). By "single-sided" it is meant that the antenna elements are located or printed on a single layer or plane when desired. As used herein, the phrase "printed antenna" applies to any single-sided antenna disclosed herein regardless of whether the elements of the printed antenna are printed or created in some other manner, such as etching, depositing, sputtering, or some other way of applying a metallic layer on a surface, or placing non-metallic material around a metallic layer. Multiple layers of the single-side antennas can be combined into a single device so as to enable wider bandwidth operations in a smaller physical volume, but each of the devices would still be single-sided. The single-sided antenna described below has no ground plane on a back side or lower plane and, on its own, is essentially a shorted device, which represents a new concept in antenna designs. The single-sided antenna is balanced, but it may be driven with either a balanced line or an unbalanced line if a significant ground plane exists in the intended application device. The physical size of such an antenna can vary significantly depending on the performance characteristics of the antenna, but the antenna 400 illustrated in FIG. 4A is approximately 2 cm by 3 cm. Smaller or larger implementations are possible.

The single-sided antenna 400 consists of two electric field radiators physically located inside a magnetic loop. In particular, as illustrated in FIG. 4A, the single-sided antenna 400 consists of a magnetic loop 402, with a first electric field radiator 404 connected to the magnetic loop 402 with a first electrical trace 406, and a second electric field radiator 408 connected to the magnetic loop 402 with a second electrical trace 410. The electrical traces 406 and 410 connect the electric field radiators 404 and 408 to the magnetic loop 402 at the corresponding 90/270 degree electrical locations, with respect to the feed or drive points. Alternatively, the electrical traces 406 and 410 can connect the electric field radiators 404 and 408 to the magnetic loop at areas where current flowing through the magnetic loop is at a reflective minimum. As discussed above, for different frequencies, the connection or coupling points of the traces 406 and 410 vary, which explains why radiator 404, at one frequency, is shown connecting to the loop 402 at a different point than radiator 408, which is at a different frequency. At lower frequencies, it takes longer for a wave to arrive at the 90/270 degree point; consequently the physical location of the 90/270 degree point would be higher along the magnetic loop compared to a higher frequency wave. At higher frequencies, it takes less time to arrive at the 90/270 degree point, resulting in the physical location of the 90/270 degree point being lower along the magnetic loop compared to a lower frequency wave. Similarly, the points along the magnetic loop where current is at a reflective minimum may also depend on the frequency of the electric field radiator. Finally, alternative embodiments of the antenna 400 may consist of one or more electric field radiators coupled directly to the magnetic loop 402 without an electrical trace.

The electric field radiator 404 also has a different size than the electric field radiator 408 because each electric field radiator emits waves at different frequencies. The smaller electrical field radiator 404 would have a smaller wavelength and consequently a higher frequency. The larger electric field radiator 408 would have a longer wavelength and a lower frequency.

Physical arrangements of the electric field radiator(s) physically located inside the magnetic loop can reduce the size of the overall antenna in comparison with other embodiments where the physical location of the electric field radiator(s) and the magnetic loop are external to one another, while at the same time, providing a broadband device. Alternative embodiments can have a different number of electric field radiators, each arranged at different positions around the loop. For example, a first embodiment may have only one electric field radiator located inside of the magnetic loop, while a second embodiment with two electric field radiators may have one electric field radiator on the inside the magnetic loop and the second electric field radiator on the outside of the magnetic loop. Alternatively, more than two electric field radiators may be physically located inside the magnetic loop. As with the other antennas described above, the single-sided antenna 400 is a transducer by virtue of the electric and magnetic fields.

As noted, the use of multiple electric field radiators allows for wideband functionality. Each electric field radiator can be configured to emit waves at different frequencies, resulting in the electric field radiators covering a broadband range. For example, the single-sided antenna 400 can be configured to cover the standard IEEE 802.11b/g wireless frequency range with the use of two electric field radiators configured at two frequency ranges. The first electric field radiator 404, for example, may be configured to cover the 2.41 GHz frequency, while a second electric field radiator 408, for example, may be configured to cover the 2.485 GHz frequency. This would allow the single-sided antenna 400 to cover the frequency band of 2.41 GHz to 2.485 GHz, which corresponds to the IEEE 802.11b/g standard. The use of two or more electric field radiators creates wideband operation without the use of a phase tracker (as shown in FIGS. 2 and 3), as is illustrated with respect to the physically larger antenna embodiments described above. In an alternative embodiment, by tapering multiple electric field radiators using a log scale, similar to a YAGI antenna, a wideband antenna can also be achieved.

The length of the electric field radiators generally determines the frequencies they will cover. Frequency is inversely proportional to wavelength. Thus, a small electric field radiator would have a smaller wavelength, resulting in a higher frequency wave. On the other hand, a large electric field radiator would have a longer wavelength, resulting in a lower frequency wave. However, these generalizations are also implementation specific.

For optimal efficiency, an electric field radiator should have an electrical length of approximately a multiple of a wavelength, a quarter wavelength or an eighth wavelength at the frequency it generates. As previously mentioned, if the amount of available physical space limits the electrical length of the electric field radiator to less than a desired wavelength, a meandering trace may be used to add propagation delay and electrically lengthen the electric field radiator.

In FIGS. 4A and 4B, the electrical traces 406 and 410 are inductors and their respective length, versus their shape or other characteristics, determines their inductance. For optimal efficiency, the inductive reactance of the electrical trace should match the capacitive reactance of the corresponding electric field radiator. The electrical traces 406 and 410 are bent in order to reduce the overall size of the antenna. For example, the curve of the electrical trace 406 could have been closer to the magnetic loop 402 instead of being closer to the electric field radiator 404, or the curve of the trace 406 could have been facing down instead of up, similar to the electrical trace 410. The electrical traces are shaped in order to expand their length, and not because the shape has any particular significance other than in that context. For example, instead of having a straight electrical trace, a curve can be added to the electrical trace in order to increase its length, and correspondingly increase its inductive reactance. However, sharp corners on the electrical trace and sinusoidal shapes of the electrical trace can affect negatively the efficiency of the antenna. In particular, an electrical trace with a sinusoidal shape results in the electrical trace emitting a small electric field that partially outphases the electric field radiator, thus reducing the efficiency of the antenna. Therefore, the efficiency of the antenna can be improved by using an electrical trace shaped with soft and graceful curves, and with as few bends as possible.

The spacing between elements in the single-sided antenna 400 adds capacitance to the overall antenna. For example, the spacing between the top of the electric field radiator 404 and the magnetic loop 402, the spacing between the two electric field radiators 404 and 408, the spacing between the left of the electric field radiators 404 and 408 and the magnetic loop 402, the spacing between the right side of the electric field radiators 404 and 408 and the magnetic loop 402, and the spacing between the bottom of the electric field radiator 408 and the magnetic loop 402 all impact the capacitance of the antenna 400. As previously stated, for the antenna 400 to resonate with optimal efficiency, the inductive reactance and capacitive reactance of the overall antenna should match at the desired frequency band(s). Once the inductive reactance has been determined, the distance between the various elements can be determined based on the capacitive reactance value needed to match the inductive reactance value for the antenna.

Given a set of formulas to find the spacing between elements and associated edge capacitance, an optimal spacing between elements can be determined using multi-objective optimization. The optimal spacing between elements, or between any two adjacent antenna elements, can be optimized using linear programming. Alternatively, non-linear programming, such as a genetic algorithm, can be used to optimize the spacing values.

As previously noted, the size of the single-sided antenna 400 depends on a number of factors, including the desired frequency of operation, narrowband versus wideband functionality, and the tuning of capacitance and inductance.

In the case of the antenna element 400 in FIG. 4A, the length of the magnetic loop 402 is one wavelength (360 degrees), which is designed for optimal efficiency, although multiples of other wavelengths could also be used. When designed for optimal efficiency, a portion of the magnetic loop will also act as an electric field radiator, and the electric field radiator will generate a small magnetic field, adding to the directivity and efficiency of the antenna. The length of the magnetic loop also could be arbitrary, or a multiple of approximately a wavelength, a quarter wavelength, or an eighth wavelength, for which certain lengths increase efficiency more than others. One wavelength is an open circuit for voltage and a short circuit for current. Alternatively, the length of the magnetic loop 402 can be physically less than a wavelength but extra inductance can be added to electrically lengthen the loop by increasing propagation delay. The width of the magnetic loop 402 is primarily based on the desired effect it has on the inductance of the magnetic loop 402 as well as its capacitance. For example, making the magnetic loop 402 physically shorter would make the wavelength smaller, resulting in a higher frequency. In the design for optimum efficiency of the magnetic loop 402, inductance and capacitance should satisfy the equation of w=1/sqrt(LC), where w is the wavelength of the loop 402. Hence, the magnetic loop 402 can be tuned by varying its inductance and capacitance which affects the electrical length. Reducing the width of the magnetic loop also adds inductance. In a thinner magnetic loop, more electrons have to squeeze through a smaller area, adding delay.

The top part 412 of the magnetic loop 402 is thinner than any other part of the magnetic loop 402. This allows for the size of the magnetic loop to be adjusted. The top part 412 can be reduced since it has minimal effect on the 90/270 degree connection point. In addition, shaving the top part 412 of the magnetic loop 402 increases the electrical length of the magnetic loop 402 and increases inductance, which can help the inductive reactance match the total capacitive reactance of the antenna. Alternatively, the height of the top part 412 can be increased to increase capacitance (or equivalently decrease inductance). As previously mentioned, the reflective minimum connection point depends on the geometry of the magnetic loop. Therefore, changing the geometry of the loop by shaving the top part 412 or increasing the top part 412, or by changing any other aspect of the magnetic loop, will require the point where current is at a reflective minimum to be identified after the loop geometry is modified.

The magnetic loop 402 does not have to be square as illustrated in FIG. 4A. In an embodiment, the magnetic loop 402 can be rectangular shaped or odd shaped and the two electric field radiators 404 and 408 can be placed at the corresponding 90/270 degree connection point or at the reflective minimum connection point. For optimal efficiency, the electrical length of the odd shaped loop would be approximately a multiple of a wavelength, or approximately a multiple of a quarter or an eighth wavelength at the desired frequency band(s). The electric field radiators can be placed on the inside or the outside of the odd shaped magnetic loop. Again, the key is to identify the connection point along the magnetic loop which maximizes the efficiency of the antenna. The connection point may be the 90/270 degree electrical point along the magnetic loop or the point where current flowing through the magnetic loop is at a reflective minimum.

For example, in a smart phone, an odd shaped antenna design can be fit into an available odd shaped space, such as the back cover of a mobile device. Instead of the magnetic loop being square shaped, it could be rectangular shaped, circular shaped, ellipsoid shaped, substantially E shaped, substantially S shaped, etc. Similarly, a small odd-shaped antenna can be fit into a non-uniform space on a laptop computer or other portable electronic device.

As discussed above, the location of the electrical trace can be at about the 90/270 degree electrical point along the magnetic loop or at the reflective minimum connection point so that the electric field emitted by the electric field radiator is orthogonal to the magnetic field generated by the magnetic loop. The 90/270 connection point and the reflective minimum connection point are important because these points allow the reactive power (imaginary power) to be transmitted away from the antenna and not return. Reactive power is typically generated and stored around the antenna's near field. Reactive power oscillates about a fixed position near the source and it impacts the operation of the antenna.

In reference to FIG. 4A, the dashed line 414 indicates where the most significant areas of the phenomenon of edge capacitance occur. Two pieces of metal within the antennas, such as the magnetic loop and the electric field radiators, at a certain distance apart, can create a level of edge capacitance. Through the use of edge capacitance, embodiments of the single-sided antenna allow for all elements of the antenna to be printed on one side of almost any type of suitable substrate materials, including inexpensive dielectric materials. An example of an inexpensive dielectric material that can be used as the substrate includes the glass reinforced epoxy laminate FR-4, which has a dielectric constant of about 4.7±0.2. In the single-sided antenna 400, for example, there is no need for a back side or ground plane. Rather, a lead connects to each end of the magnetic loop, with one of the leads being grounded. As previously noted, this full wavelength antenna design implies an optimally efficient short circuited, compound loop antenna. In practice, the single-sided antenna would perform most optimally in the presence of a counterpoise ground plane as is common in embedded antenna design in which the counterpoise is provided by an object in which the antenna is mounted.

The 2D design of embodiments of the single-sided antenna has several advantages. With the use of an appropriate substrate or dielectric base, which can be very thin, the traces of the antenna can literally be sprayed or printed on the surface and still function as a compound loop antenna. In addition, the 2D design allows for the use of antenna materials typically not seen as appropriate for microwave devices, such as very inexpensive substrates. A further advantage is that an antenna can be placed on odd shaped surfaces, such as the back of a cell phone case cover, edges of a laptop, etc. Embodiments of the single-sided antenna can be printed on a dielectric surface, with an adhesive placed on the back of the antenna. The antenna can then be adhered on a variety of computing devices, with leads connected to the antenna to provide needed power and ground. For example, as noted above, with this design, an IEEE 802.11b/g wireless antenna can be printed on a surface about the size of a post stamp. The antenna could be adhered to the cover of a laptop, the case of a desktop computer, or the back cover of a cell phone or other portable electronic device.

A variety of dielectric materials can be used with embodiments of the single-sided antenna. The advantage of FR-4 as a substrate over other dielectric materials, such as polytetrafluoroethylene (PTFE), is that it has a lower cost. Dielectrics typically used for higher frequency antenna design have much lower loss properties than FR-4, but they can cost substantially more than FR-4.

Embodiments of the single-sided antenna can also be used for narrowband applications. Narrowband refers to a channel where the bandwidth of the message does not exceed the channel's coherence bandwidth. In wideband the message bandwidth significantly exceeds the channel's coherence bandwidth. Narrowband antenna applications include Wi-Fi and point-to-point long distance microwave links. In accordance with the embodiments described above, for example, an array of narrowband antennas can be printed on a sticker that can then be placed on a laptop for Wi-Fi access over great distances and good signal strength compared to standard Wi-Fi antennas.

FIG. 4B illustrates an alternative embodiment of a single-sided antenna 420, with a magnetic loop 422 whose corners are cut at about a 45 degree angle. Cutting the corners of the magnetic loop 422 at an angle improves the efficiency of the antenna. Having a magnetic loop with corners forming approximately a 90 degree angle affects the flow of the current flowing through the magnetic loop. When the current flowing through the magnetic loop hits a 90 degree angle corner, it makes the current ricochet, with the reflected current flowing either against the main current flow or forming an eddy pool. The energy lost as a consequence of the 90 degree corners can affect negatively the performance of the antenna, most notably in smaller antenna embodiments. Cutting the corners of the magnetic loop at approximately a 45 degree angle improves the flow of current around the corners of the magnetic loop. Thus, the angled corners enable the electrons in the current to be less impeded as they flow through the magnetic loop. While cutting the corners at a 45 degree angle is preferable, alternative embodiments that are cut at an angle different than 45 degrees are also possible.

FIG. 4C illustrates an alternative embodiment of a single-sided antenna 440 that uses transitions of various widths in the magnetic loop 442 to either add inductance or add capacitance to the magnetic loop 442. The corners of the magnetic loop 442 have been cut at approximately a 45 degree angle in order to improve the flow of current as it flows around the corners of the magnetic loop 442, thereby increasing the efficiency of the antenna. A single electric field radiator 444 is physically located inside of the magnetic loop 442. The electric field radiator 444 is connected to the magnetic loop 442 with an electrical trace 446 having a soft curved shape. As previously discussed, having an electrical trace 446 with soft curves, that is not sinusoidal shaped and minimizes the number of bends in the trace, improves the efficiency of the antenna.

The term transition is used to refer to a change in the width of the magnetic loop. In FIG. 4C, the magnetic loop 442 is substantially rectangular shaped and it includes a first transition on the left side and a second transition on the right side. In the embodiment illustrated in FIG. 4C the first transition is symmetric to the second transition. The transition on both the left and the right sides of the magnetic loop 442 include a middle narrow section 448, or middle narrow segment, which is thinner than the rest of the magnetic loop 442 and which is located between and adjacent to a first wide section 450 and a second wide section 452, the first wide section 450 and the second wide section 452 having widths greater than the narrow section 448. Specifically, the magnetic loop transitions from the first wide section 450 to the middle narrow section 448, with the middle narrow section 448 transitioning to the second wide section 452. A wide-narrow-wide transition in the magnetic loop produces pure inductance, thus increasing the electrical length of the magnetic loop. Therefore, the use of wide-narrow-wide transitions in a magnetic loop is a method of increasing the electrical length of the magnetic loop 442 by adding inductance to the magnetic loop 442. The length of the middle narrow section 448 can also be increased or decreased as necessary to add the desired inductance to the magnetic loop. For example, in FIG. 4C the middle narrow section 448 spans about one quarter of the left side and the right side of the magnetic loop 442. However, the middle narrow section 448 can be increased to span about half, or some other ratio, of the left side and the right side of the magnetic loop 442, thereby increasing the inductance of the magnetic loop 442.

Transitions are not limited to sections or segments having a width less than the rest of the magnetic loop 442. An alternative transition can include a middle wide section, or middle wide segment, that is wider than the rest of the magnetic loop 442 and which is located between and adjacent to a first narrow section and a second narrow section, the first narrow section and the second narrow section having widths less than the wide section. Specifically, in such an alternative embodiment the magnetic loop transitions from the first narrow section to the middle wide section, with the middle wide section subsequently transitioning to the second narrow section. A narrow-wide-narrow transition in the magnetic loop produces capacitance, thereby shortening the electrical length of the magnetic loop. The length of the middle wide section can be increased or decreased to add capacitance to the magnetic loop.

Using transitions in the magnetic loop, that is, varying the width of the magnetic loop over one or more sections or segments of the magnetic loop serves as a method for tuning impedance matching. The transitions of varying widths in the magnetic loop can also be tapered to further add inductance or capacitance in order to ensure that the reactive inductance and the reactive capacitance of all the elements in the antenna are matched. For example, in a wide-narrow-wide transition, the first wide section can taper from its larger width to the smaller width of the middle narrow section. Similarly, the middle narrow section can taper from its narrow width to the larger width of either the first wide section or the second wide section, or to both. The sections in a narrow-wide-narrow transition and in a wide-narrow-wide transition can be tapered independently of each other. For instance, in a first narrow-wide-narrow transition, only the middle wide section may be tapered, while in a second narrow-wide-narrow transition only the first narrow section may be tapered. The tapering can be linear, step-like, or curved.

The actual difference in width between the portions of the magnetic loop will depend on the amount of inductance or capacitance needed to ensure that the total reactive capacitance of the antenna matches the total reactive inductance of the antenna. The embodiment illustrated in FIG. 4C shows two wide-narrow-wide transitions that are located opposite of each other and are symmetrical. However, alternative embodiments can have a transition on only one side of the magnetic loop 442. In addition, if more than one transition is used in a magnetic loop, these transitions need not be symmetric. For example, an odd shaped magnetic loop may have two transitions, with the transitions having differing lengths and widths. In addition, different types of transitions can also be used on a single magnetic loop. For instance, a magnetic loop can have both one or more narrow-wide-narrow transitions and one or more wide-narrow-wide transitions.

Figure 5:
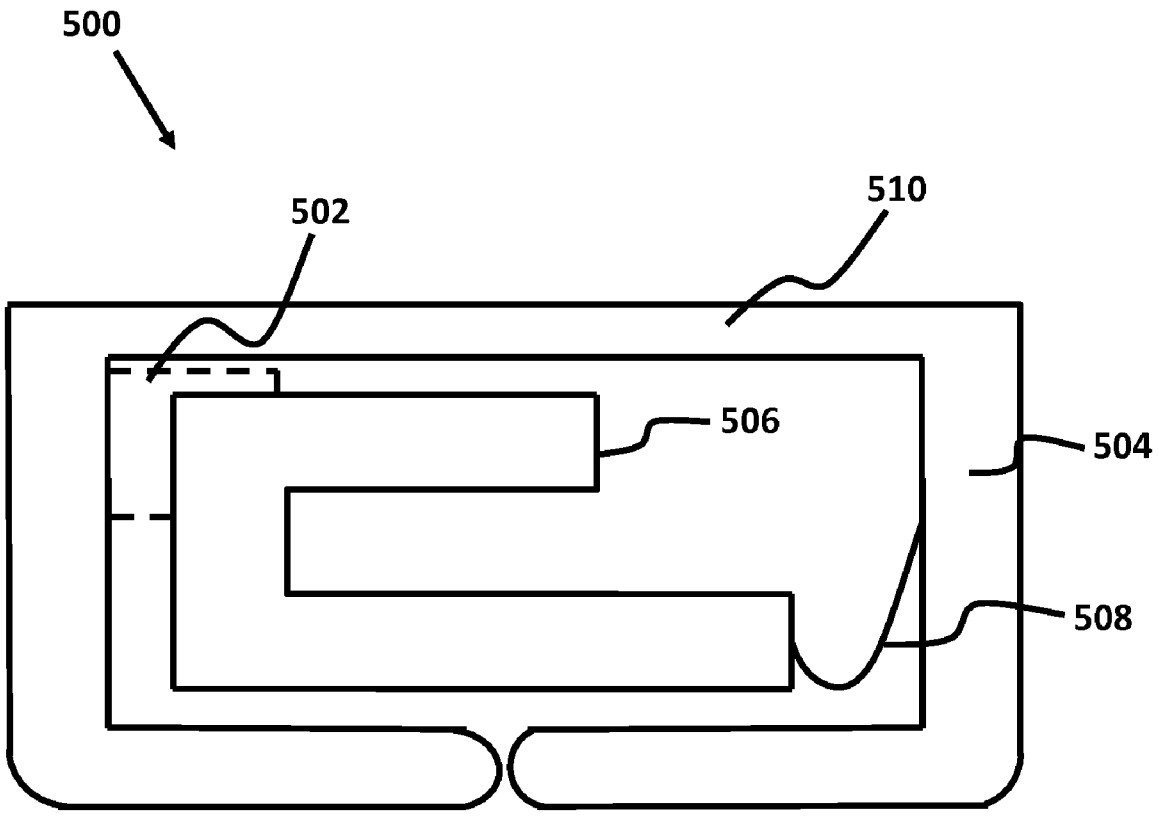
FIG. 5 illustrates an embodiment of a small, double-sided compound antenna.

FIG. 5 illustrates an embodiment of a small, doubled-sided or planar antenna 500. The planar antenna 500 makes use of a second plane on a back side that comprises a tunable patch, illustrated by the dashed line 502, which creates capacitive reactance to match the inductive reactance of the magnetic loop 504 for a particular frequency. The tunable patch 502 is a substantially square piece of metal that has a flexible location relative to the other elements of the antenna 500. In embodiments, the tunable patch 502 should be located at a point away from the 90/270 degree electrical point along the magnetic loop or at a point away from the area where current is at a reflective minimum, such as in the upper left corner of the antenna 500, as shown in FIG. 5. The electric field radiator 506 is located inside of the magnetic loop 504 in order to reduce the overall size of the double sided antenna 500. For optimal efficiency, the electric field radiator 506 should have an electrical length approximately equal to one quarter wavelength at its corresponding operating frequency. If the electric field radiator was made smaller, then it would result in a smaller wavelength at a higher frequency. The electric field radiator 506 is bent into a substantially J shape in order to fit its entire length inside of the magnetic loop 504. Alternatively, the electric field radiator 506 may be stretched so it lies on a straight line, rather than bending into a J shape, or bending into an alternative shape. While such an embodiment is contemplated herein, it would make the antenna wider and would increase the overall size of the antenna.

The electrical trace 508 connects the electric field radiator 506 to the magnetic loop 504 at the 90/270 connection point or at the minimum reflective connection point. The top part 510 of the magnetic loop 504 is smaller compared to the other sides of the magnetic loop 504. This serves the purpose of increasing inductance and lengthening the electrical length of the magnetic loop 504. Increasing inductance further enables the inductive reactance to match the overall capacitive reactance of the antenna 500, as was the case in the small, single-sided antenna 400, and can be adjusted as discussed above.

The tunable patch 502 can also be located anywhere along the top part 510 of the magnetic loop 504. However, having the tunable patch 502 away from the point at which the magnetic loop 504 connects to the electric field radiator 506 yields better performance. The size of the tunable patch 502 can also be increased by changing its depth, length, and height. Increasing the depth of the tunable patch 502 will result in an antenna design which takes up more space. Alternatively, the tunable patch 502 can be made very thin, but its length and height can be adjusted accordingly. Instead of having the tunable patch 502 covering the top left corner of the antenna 500, the length and height could be increased in order to cover the left half of the antenna 500. Alternatively, the length of the tunable patch 502 can be increased, allowing it to expand the top half of the antenna 500. Similarly, the height of the tunable patch 502 can be increased, allowing it to expand the left side of the antenna 500. The tunable patch could also be made smaller.

Similar to the single-sided antenna, a variety of dielectric materials can be used with embodiments of the double-sided antenna 500. Dielectric materials that can be used include FR-4, PTFE, cross-linked polystyrenes, etc.

Figure 6:
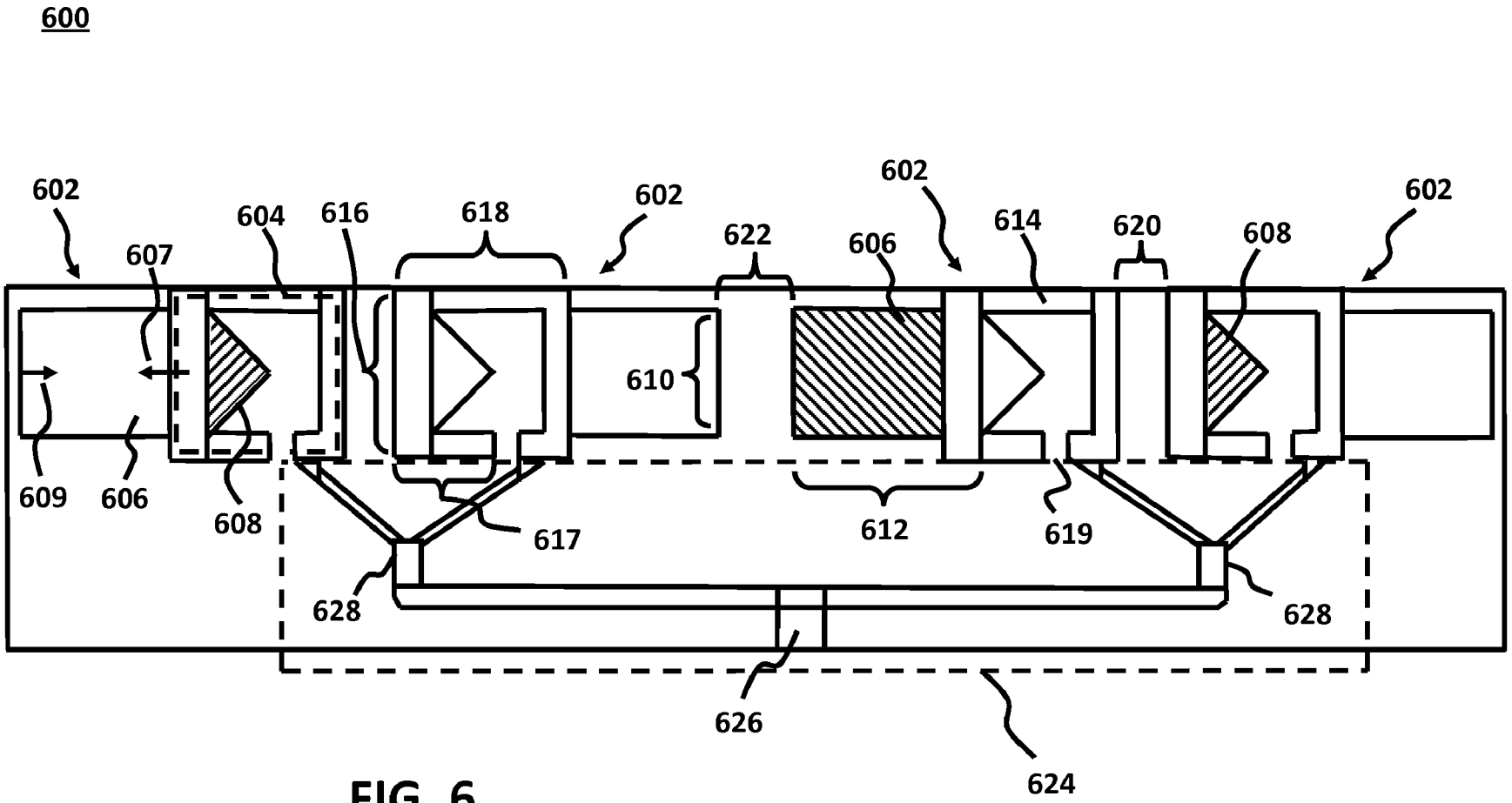
FIG. 6 illustrates an embodiment of a large compound antenna array comprised of four compound antenna elements.

FIG. 6 illustrates an embodiment of a large antenna 600, consisting of an array of four antenna elements 602, with a bandwidth of as much as one and one-half octaves. Each antenna element 602 consists of a TE mode (transverse electric) radiator, or magnetic (H field) radiator, or magnetic loop dipole 604 (roughly indicated by the dashed line and referred to as magnetic loop 604) and a TM mode (transverse magnetic) radiator, or electric (E field) radiator, or electric field dipole 606 (indicated by the rectangular-shaped shaded area and referred to as electric field radiator 606) external to the magnetic loop 604. The magnetic loop 604 must be electrically one wavelength, which creates a short circuit. While the magnetic loop 604 can be physically less than one wavelength, adding extra inductance, as discussed below, will electrically lengthen the magnetic loop 604. The physical width of the magnetic loop 604 is also adjustable in order to obtain the proper inductance/capacitance of the magnetic loop 604 so it will resonate at the desired frequency. As noted below, the physical parameters of the magnetic loop 604 are not dependent on the quality of the dielectric material used for the antenna elements 602.

As previously discussed, the magnetic loop 604 is a complete short so as to maximize the amount of current in the magnetic loop and so as to generate the highest H field. At the same time, impedance is matched from the transmitter to the load so as to prevent the transmitter from being burned out as a result of the short. Current moves in the direction of the arrow 607 from the magnetic loop 604 into the electric field radiator 606 and is reflected back in the opposite direction (from the electric field radiator 606 into the magnetic loop 604 in the direction of arrow 609).

In an embodiment, each of the antenna elements 602 are about 4.45 centimeters wide by about 2.54 centimeters high, as illustrated in FIG. 6. However, as previously stated, the size of all components is determined by the frequency of operation and other characteristics. For example, the traces of the magnetic loop 604 can be made very thick, which increases the gain of the antenna element 602 and allows the physical size of the antenna element 602, and subsequently the size of the antenna 600, to be modified to fit any desired physical space, yet still be in resonance, while maintaining some of the same increased gain and maintaining a similar level of efficiency, none of which is possible with prior art voltage fed antennas. As long as a modified design maintains (1) a magnetic loop with inherit closed-form surface currents, (2) the reflection of energy from the E field radiator into the magnetic loop, and (3) the matched impedance of the components, the antenna can be adjusted to almost any size. Although gain will vary based on the particular size and shape selected for the antenna, similar levels of efficiency can be achieved.

A phase tracker 608 (indicated by the triangular-shaped shaded area) makes the antenna 600 wideband and can be eliminated for narrowband designs. The tip of the phase tracker 608 is ideally located at the 90/270 degree electrical location along the magnetic loop 604. However, in alternative embodiments the tip of the phase tracker can be located at the minimum reflective connection point. The dimension 610 of the electric field radiator 606 does not really matter to the overall operation of the antenna element 602. Dimension 610 only has a width to make the antenna element 602 wideband and dimension 610 can be reduced if the antenna element 602 is intended to be a narrowband device. As illustrated, antenna element 602 is intended to be wideband because it includes the phase tracker 608. Dimension 612 is determined by the center frequency of operation and determines the phase of the antenna element 602. The dimension 612 spans the length of the electric field radiator 606 and the length of left side of the magnetic loop 604. Dimension 612 would typically be one quarter wavelength, with slight adjustment for the dielectric material used as the substrate. The electric field radiator 606 has a length which represents about a quarter wavelength at the frequency of interest. The length of the electric field radiator 606 can also be sized to be a multiple of a quarter wavelength at the frequency of interest, but these changes can reduce the effectiveness of the antenna.

The width of top part 614 of the magnetic loop 604 is intended to be smaller than any other part of the magnetic loop 604, although this difference may not be apparent in the drawing of FIG. 6. This size differential is similar to the smaller antenna embodiments previously discussed, where the top part 614 can be shaved in order to increase electrical length and add inductance. The top part 614 of the magnetic loop 604 can be shaved since it has minimal affect on the 90/270 degree electrical location. Adding inductance by shaving the top part 614 makes the magnetic loop 604 appear electrically longer.

Dimensions 616, 617 and 618 of the magnetic loop 604 are all determined by the wavelength dimension. Dimension 616 consists of the width of the magnetic loop 604. Dimension 617 consists of the length of the left portion of the bottom side of the magnetic loop 604. That is, dimension 617 consists of the length of the bottom portion of the magnetic loop 604 to the left of the magnetic loop opening 619. Dimension 618 consists of the entire length of the magnetic loop 604. The best antenna performance is achieved when the dimension 616 is equal in size to dimension 618, resulting in a square loop. However, a magnetic loop 604 that is rectangular or irregularly shaped can also be used.

Figure 7:
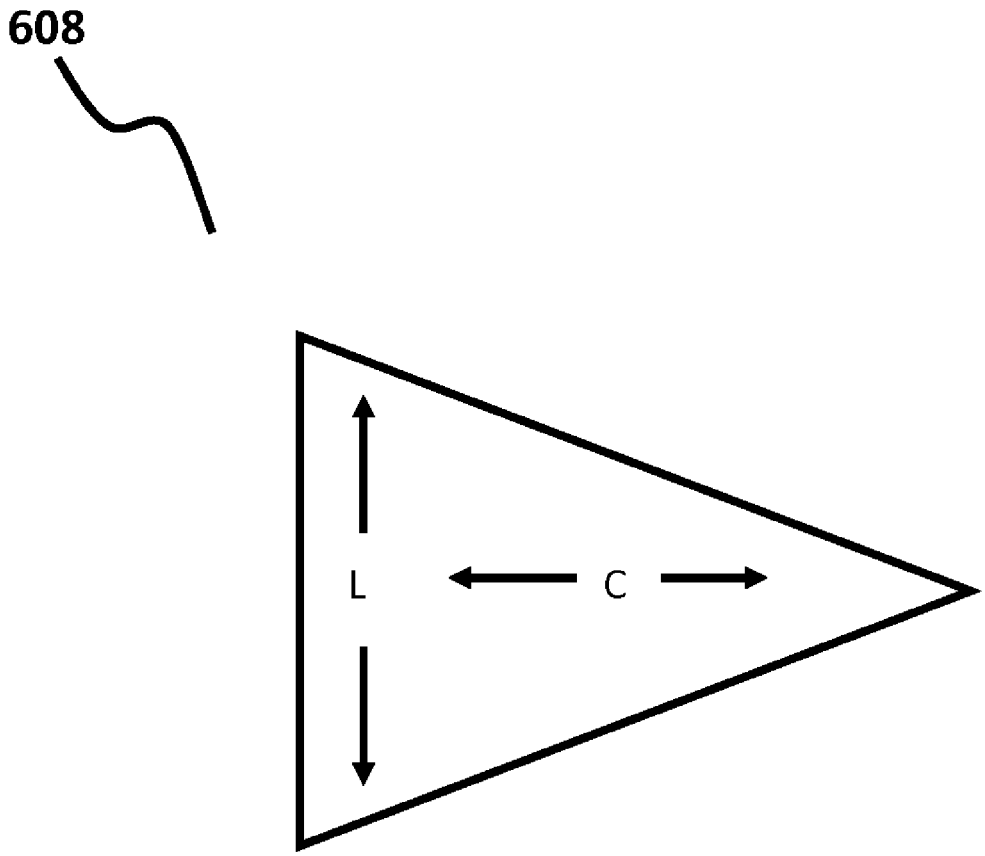
FIG. 7 illustrates how the dimensions of the phase tracker affect its inductance and capacitance.

As previously noted, the phase tracker 608 is included for wideband operation of the antenna 600 and removing the phase tracker 608 makes the antenna 600 less wideband. The antenna 600 may alternatively be made narrowband by reducing the physical vertical dimension of the phase tracker 608 and the dimensions of electric field radiator 606. The phase tracker 608, and its support of wideband operation in an antenna, has the potential to reduce the total number of antennas used in various devices, such as cell phones. The dimensions of the phase tracker 608 also affect its inductance and capacitance as illustrated in FIG. 7. The capacitance and inductance ranges of the phase tracker 608 can be tuned by adjusting the physical dimensions of the phase tracker 608. The inductance (L) of the phase tracker 608 is based on the height of the phase tracker 608. The capacitance (C) of the phase tracker 608 is based on the width of the phase tracker 608.

The antenna elements 602 and the pairs of antenna elements 602 have a set of gaps formed between them. The two antenna elements 602 located on the left side of antenna 600 constitute a first pair of antenna elements 602, whereas the two antenna elements 602 located on the right side of antenna 600 constitute a second pair of antenna elements 602. There is a first gap 620 between each pair of antenna elements 602, and a second gap 622 between each set of pairs of antenna elements 602. The first gap 620 between each pair of elements 602 and the second gap 622 between each set of pairs of antenna elements 602 are designed to align the far-field radiation patterns generated by the antenna elements 602 in a most efficient manner, such that the far-field radiation patterns are additive rather than subtractive. Well known phased antenna array techniques may be used to determine the optimal spacing between multiple CPL antenna elements 602, such that each element's far field radiation pattern is additive.

In an embodiment, the far-field radiation patterns can be modeled on a computer based on the relationship of the different components of the antenna elements 602. For example, the size of the antenna elements 602, the spacing between antenna elements 602 and between pairs of antenna elements 602, and the relationship of the components can be adjusted until an additive orientation and alignment of the far-field radiation patterns has been achieved. Alternatively, the far-field radiation patterns can be measured using electrical equipment, with the relationship of the components adjusted on that basis.

Referring now back to FIG. 6, the antenna elements 602 are fed by microstrip feed lines represented by the dashed line 624. The feed lines within the dashed line 624 match the network to drive impedance and are dependent on the dielectric material used. The symmetry of the feed lines is also important to avoid unnecessary phase delays that can result in the far-field radiation patterns generated by the antenna elements being subtractive instead of additive.

In reference to FIG. 6, an embodiment uses a common combiner/splitter 626 to split the incoming signal in two so as to feed the two sets of antenna elements and to combine the returning signals. The second and third combiners/splitters 628 thereafter split the resulting signals in two so as to feed each pair of antenna elements 602 and to combine the returning signals. The combiners/splitters 626 and 628 are desirable because they result in a nearly perfect impedance match along the feed lines over a wide frequency range and prevent power from being reflected back along the feed lines, which can result in performance loss.

Figure 8:
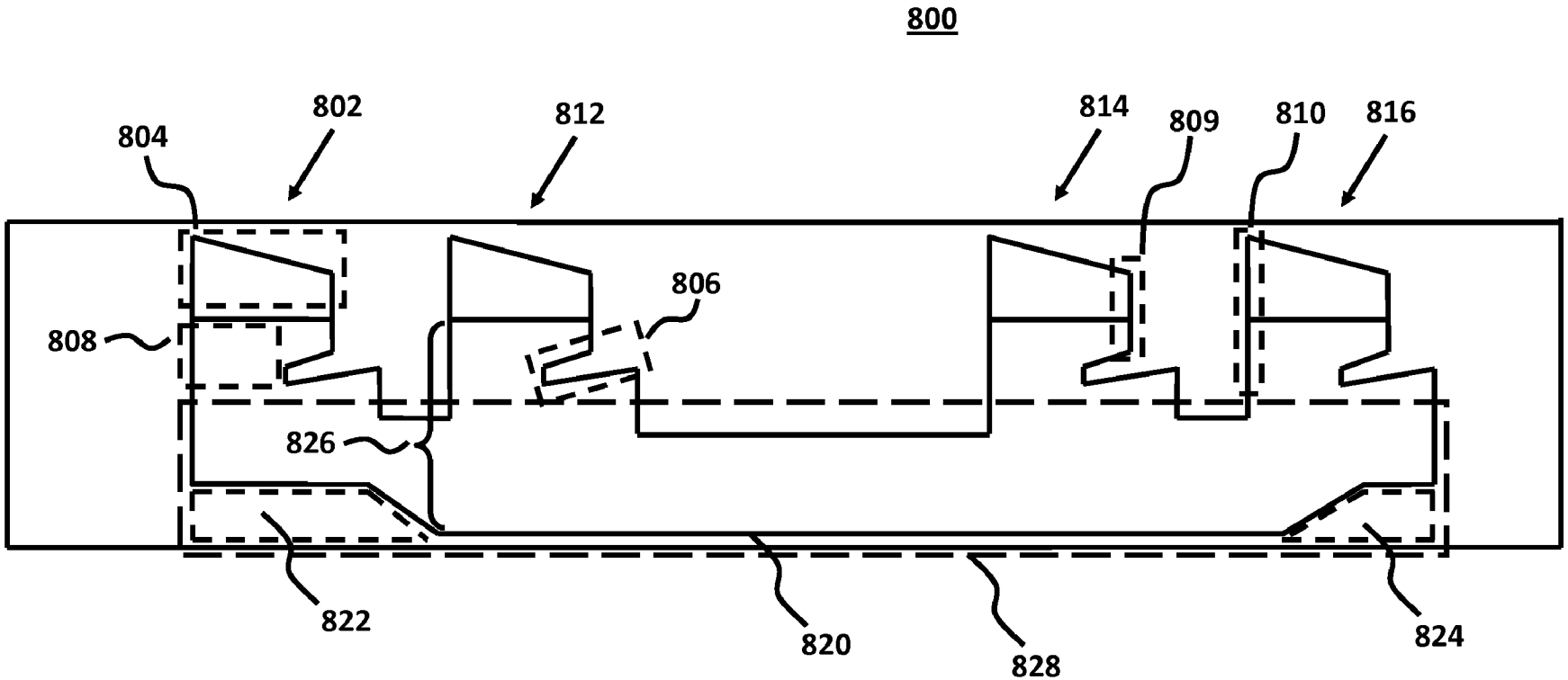
FIG. 8 illustrates the ground plane of the antenna embodiment of FIG. 6.

FIG. 8 illustrates the bottom layer 800 of the antenna 600, which includes elements 802, 812, 814 and 816, each of these elements including a trapezoidal element 804, a choke joint area 806 and a raiser 808. Elements 802, 812, 814 and 816 act as capacitors, although elements 812 and 814 also set the phase angle of the antenna 600 by reflecting the signal, or RF energy, to the bottom of the bridge element 820. The distance 826 from the bottom of the trapezoidal elements 804 to the bottom of the bridge element 820 cannot be greater than one-quarter wavelength if a spherical shape to the result pattern generated by the antenna 600 is desired. By changing the distance 826 for each of the elements 802, 812, 814 and 816, different shaped radiation patterns can be created. Finally, cutout elements 822 and 824 represent where trace materials have been removed from a bottom left corner and a bottom right corner of bridge element 820 to prevent reflections of the elements 802 and 816, which would, in turn, change the phase angle set by elements 812 and 814.

The trapezoidal elements 804 keep the magnetic loop 604 of each corresponding antenna element 602 in tune by virtue of the fact that each trapezoidal element 804 is log driven in dimension. The slope of each trapezoidal element 804, in particular the slope of the top side of the trapezoidal element 804, is used to add varying inductance and capacitance to help match inductive reactance to capacitive reactance in the antenna 600. By adding capacitance through the trapezoidal elements 804, the electrical length of each corresponding magnetic loop 604 on the other side of the antenna 600 can be adjusted. The trapezoidal elements 804 are aligned with the top trace 614 of the magnetic loop 604 on the other side of the antenna 600. The choke joints 806 serve to isolate the trapezoidal elements 804 from ground and thereby prevent leakage of the resultant signal. The sides 809 and 810 of the trapezoid elements 804 are counterpoises to the electric field radiators 606 on the other side of the antenna 600, which need a ground to set polarization. The side 809 consists of the right side of the trapezoidal elements 804 and the top right portion of the raiser 808 that lies above of the choke joint 806. That is, side 810 consists of the right side of each element 802, 812, 814, and 816 that lies above of the choke joint 806. The side 810 consists of the left side of the trapezoidal elements 804 and the left side of the raiser 808. That is, side 810 consists of the left side of each element 802, 812, 814, and 816 that lies above of the ground plane element 828. The counterpoises 809 and 810 increase the transmitting/receiving efficiency of the antenna 600. The ground plane element 828 is standard for microstrip antenna designs, where for example, a 50 ohm trace on 4.7 dielectric is about 100 mils wide.

As previously noted, the trapezoid elements 804 can be fine-tuned in order to change capacitance or change inductance of the corresponding magnetic loop. The fine-tuning process includes shrinking or enlarging sections of the trapezoid elements 804. For example, it may be determined that additional capacitive reactance is needed in order to match the inductive reactance of the magnetic loop. The trapezoid elements 804 may therefore be enlarged to increase capacitance. An alternative fine-tuning step is to change the slopes of the trapezoid elements 804. For example, the slope may be changed from a 15 degree angle to a 30 degree angle. Alternatively, if the magnetic loop 604 is modified, by either increasing its area, or by shaving the width of the top trace 614 of the magnetic loop 604, then the metal on the ground plane corresponding to the modified magnetic loop 604 must be adjusted accordingly. For instance, the top side of the trapezoid element 804, or the overall length of the trapezoid element 804, may be shaved or increased based on whether the top trace 614 of the magnetic loop 604 was shaved or increased.

The simultaneous excitation of TM and TE radiators, as described herein, results in zero reactive power as predicted by the time dependent Poynting theorem when used to analyze microwave energy. Previous attempts to build compound antennas having TE and TM radiators electrically orthogonal to each other have relied upon three dimensional arrangements of these elements. Such designs cannot be readily commercialized. In addition, previously proposed compound antenna designs have been fed with separate power sources at two or more locations in each loop. In the various embodiments of antennas as disclosed herein, the magnetic loop and the electric field radiator(s) are positioned at 90/270 electrical degrees of each other yet lie on the same plane and are fed with power from a single location. This results in a two-dimensional arrangement that reduces the physical arrangement complexity and enhances commercialization. Alternatively, the electric field radiator(s) can be positioned on the magnetic loop at a point where current flowing through the magnetic loop is at a reflective minimum.

Embodiments of the antennas disclosed herein have a greater efficiency than traditional antennas partially due to reactive power cancellation. In addition, embodiments have a large antenna aperture for their respective physical size. For example, a half wave antenna with an omnidirectional pattern in accordance with an embodiment will have a significantly greater gain than the usual 2.11 dBi gain of simple field dipole antennas.

Figure 9A:
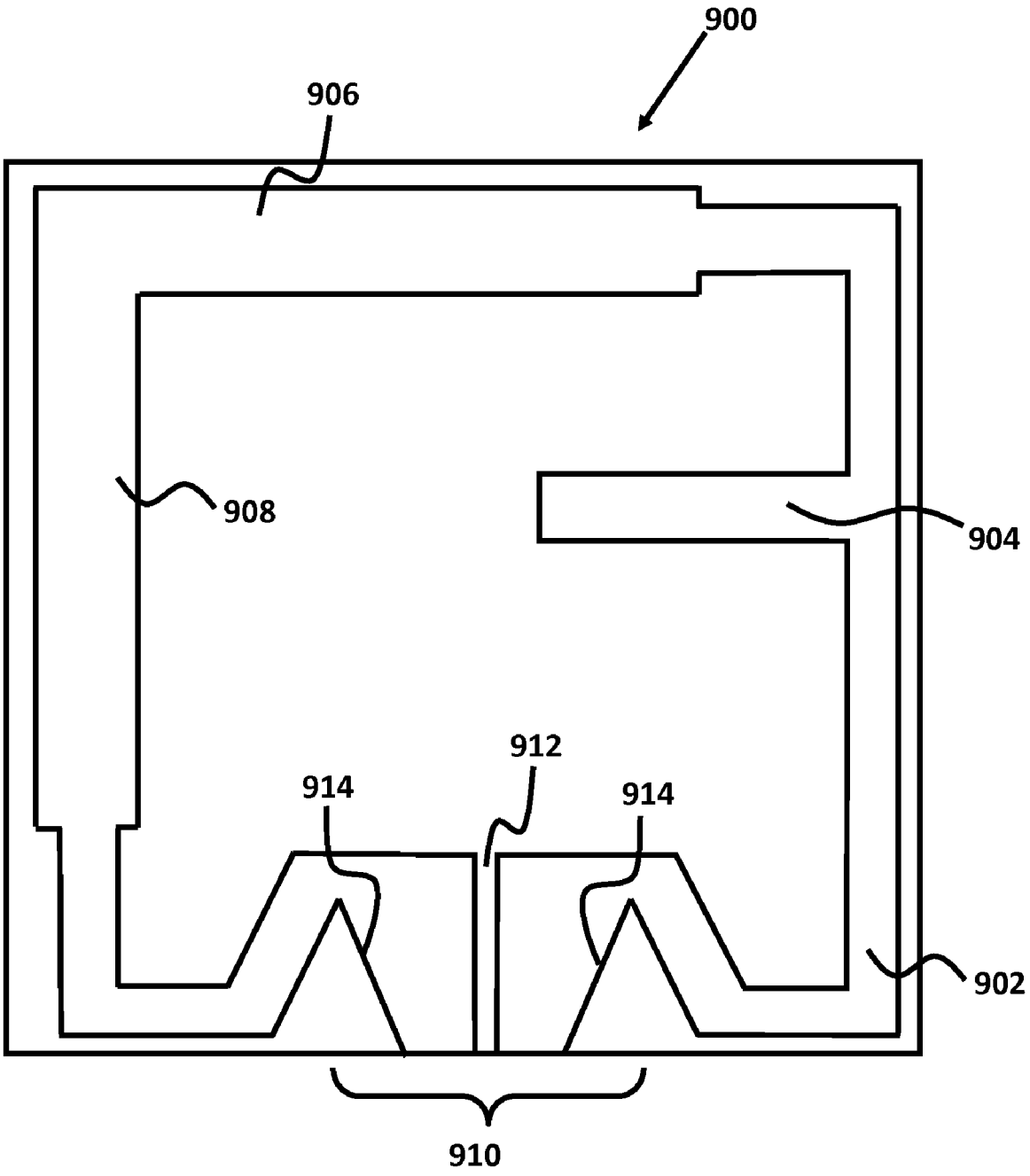
FIG. 9A illustrates an embodiment of a self-contained counterpoise antenna with a balun.

Yet another embodiment consists of a single-sided antenna with a built-in counterpoise for the electric field radiator. FIG. 9A illustrates an embodiment of a single-sided 2300 to 2700 MHz antenna with a single electric field radiator and a built-in counterpoise for the electric field radiator. The antenna 900 consists of a magnetic loop 902, with an electric field radiator 904 directly coupled to the magnetic loop 902 without the benefit of an electrical trace. The electric field radiator 904 is physically located on the inside of the magnetic loop 902. As with other embodiments, the electric field radiator 904 can be coupled to the magnetic loop 902 at the 90/270 connection point or at the point where current flowing through the magnetic loop 902 is at a reflective minimum. In alternative embodiments, the electric field radiator 904 can be coupled to the magnetic loop 902 with an electrical trace. In addition, while the antenna 900 is illustrated with one electric field radiator, alternative embodiments can include one or more electric field radiators. Alternative embodiments can also include one or more electric field radiators physically located on the outside of the magnetic loop 902.

An alternative embodiment of the self-contained antenna can also include a first electric field radiator with a first length, and a second electric field radiator with a second length different than the first length. Similar to antenna embodiments previously described herein, using one or more electric field radiators with different lengths enable wideband antennas.

The antenna 900 includes a transition 906 and a counterpoise 908 to the electric field radiator 904. The transition 906 consists of a portion of the magnetic loop 902 that has a width greater than the width of the magnetic loop 902. The transition 906 electrically isolates the built-in counterpoise 908. The built-in counterpoise 908 allows the antenna 900 to be completely independent of any ground plane or the chassis of the product using the antenna 900.

The counterpoise 908 is referred to as being built-in because the counterpoise is formed from the magnetic loop 902. As noted, the built-in counterpoise 908 allows the antenna 900 to be completely independent from the product's ground plane. Embodiments of the single-sided antenna illustrated in FIGS. 4A-4C, while being only printed on a single plane and not including a ground plane, require a ground plane to be provided by the device using the antenna. In contrast, the self-contained counterpoise antenna does not require a ground plane to be provided by the device using the antenna.

In the single-sided embodiments described above, the device using the antenna provides a ground plane for the antenna, with the ground plane of the device acting as the ground plane for the single-sided antenna, or by using the chassis of the device or some other metal component as the ground plane for the single-sided antenna. However, any modifications to the circuitry of the device, to the chassis of the device, or to the ground plane of the device can affect negatively the performance of the antenna. This phenomenon is not specific to the single-sided embodiments disclosed herein, but instead applies to antennas widely used in research and commerce. Therefore, it is desirable to have an antenna that does not require a ground plane and which would not be affected by any changes made to the device using the antenna.

By not requiring a ground plane, the antenna 900 is not dependent on a ground plane external to the antenna. This independence of the self-contained antenna 900 from an external ground plane means that the performance of the antenna is not affected by changes made to the device. In terms of manufacturing and design, this implies that a self-contained antenna can be designed for a specific frequency and a level of performance independently from the device meant to incorporate and use the antenna. For instance, a wireless router maker can request a specific antenna based on a set of requirements. These requirements may include the space available for the antenna, the frequency range for the antenna, the substrate to be used, among other requirements. The design and manufacture of the antenna can then be done independently from the design and manufacture of the actual wireless router. In addition, any future changes to the wireless router would not affect the performance and efficiency of the antenna because the antenna is self-contained and is not affected by changes to the circuitry of the router, the ground plane of the router, or the chassis of the router.

The length of the transition 906 can be set based on the frequency of operation of the antenna. For a higher frequency antenna, where the wavelength is shorter, a shorter transition can be used. On the other hand, for a lower frequency antenna, where the wavelength is longer, a longer transition 906 can be used. The transition 906 can be adjusted independently of the counterpoise 908. For example, a transition for a 5.8 GHz antenna may only be half of the size of the transition 906 in FIG. 9A, while the counterpoise 908 may still be as long as the entire left side of the magnetic loop 902.

The counterpoise 908 length can be adjusted as necessary to obtain the desired antenna performance. However, it is preferable to have as big a counterpoise 908 as possible. For example, in an alternative embodiment the counterpoise 908 can span the entire length of the left side of the magnetic loop 902, rather than only spanning about 80% of the left side of the magnetic loop 902. However, as previously described, the width of the trace of the magnetic loop 902 affects the electrical length of the magnetic loop 902. A magnetic loop with a thin trace all the way around the magnetic loop is electrically longer than a magnetic loop with a wider trace or having portions of the magnetic loop with a wider trace. For example, the magnetic loop 902 is an example of a magnetic loop which has a wider trace for the transition 906 and for the counterpoise 908. Therefore, while it is preferable to have a counterpoise as long as possible, the length of the counterpoise 908 affects the electrical length of the magnetic loop 908. A magnetic loop that is electrically longer is consequently lower in frequency. On the other hand, a magnetic loop that is electrically shorter is consequently higher in frequency. For instance, using a counterpoise that spans the entire length of the left side of the magnetic loop would increase the overall width of the magnetic loop, thus electrically shortening the magnetic loop and resulting in a magnetic loop with a higher frequency than desired. For example, resulting in a frequency of 5.8 GHz instead of a desired target frequency of 5.6 GHz.

Embodiments of the antenna 900 can also include narrow-wide-narrow transitions and/or wide-narrow-wide transitions as previously described herein, aside from the transition and the counterpoise, in order to tune the electrical length of the magnetic loop to the desired frequency. In addition, embodiments of self-contained antennas can also include magnetic loops with corners cut off at an angle as previously described in order to improve the flow of current around corners of the magnetic loops.

As previously stated, the counterpoise 908 to the electric field radiator 904 is used in place of a ground plane. The electric field radiator 904 is effectively a monopole antenna. A monopole antenna is formed by replacing one half of a dipole antenna with a ground plane at a right angle to the remaining half. In embodiments of the self-contained antennas, the electric field radiator looks for a large piece of metal electrically connected to the electric field radiator that it can use in place of the ground plane. In the single-sided antenna 440 from FIG. 4C, the electric field radiator 444 radiates an electric field based on the location of the ground plane used for the antenna 440. This electric field rotates perpendicular to the plane of the electric field radiator, while the magnetic field rotates in a manner substantially coplanar with that plane. The pattern of this electric field is substantially donut-shaped, which is also referred to as a near perfect omnidirectional pattern. As previously discussed, embodiments of the single-sided antennas do not necessarily provide their own grounds planes. Hence, if the antenna 440 was being used in a device, then the device would serve as the ground plane for the antenna 440 and the radiation pattern emitted by the electric field radiator 444 might be reflected back into the device. However, if a single-sided, self-contained antenna that includes a counterpoise, also includes a ground plane, then the radiation patterns described above would effectively switch, with the electric field rotating about the plane of the electric field radiator, or on one or more planes co-planar with the plane of the electric field radiator, and with the magnetic field rotating perpendicular to that plane.

The counterpoise 908 need not be positioned or machined on the upper left corner of the magnetic loop 902. In alternative embodiments, the counterpoise may be positioned on the upper right corner, with the electric field radiator 904 subsequently positioned on the left side of the magnetic loop 902. Regardless of the physical positions of the counterpoise 908 and the electric field radiator 904 (or radiators if more than one), the counterpoise and electric field radiator(s) do need to be 180 degrees out of phase. In yet another embodiment, the length of the counterpoise may also be adjusted as necessary. The counterpoise 908 could also be positioned along the right side of the magnetic loop 902, directly below the electric field radiator 904, or in other locations around the magnetic loop 902.

The antenna 900 further includes a balun 910. A balun is a type of electrical transformer that can convert electrical signals that are balanced about ground (differential) to signals that are unbalanced (single-ended) and vice versa. Specifically, a balun presents high impedance to common-mode signals and low impedance to differential-mode signals. The balun 910 serves the function of canceling common mode current. In addition, the balun 910 tunes the antenna 900 to the desired input impedance and tunes the impedance of the overall magnetic loop 902. The balun 910 is substantially triangular shaped and it consists of two parts divided by a middle gap 912.

The two parts of the balun 910 magnetically and electrically couple. The gap 912 in the balun 910 eliminates common mode current by magnetically preventing current from flowing in one direction, such as flowing back through the transmitter and to the device using the antenna 900. This is important because the reflection of current flow through the transmitter, due to common mode current, negatively affects the performance of the antenna 900 and of the device using the antenna 900. In particular, the reflection of current through the transmitter causes interference in the circuitry of the device using the antenna. Such negative performance can also cause the device to fail Federal Communications Commission (FCC) regulations. The gap 912 in the balun 910 cancels common mode current, thus preventing current from being reflected back into the connector of the antenna 900.

The gap 912 can be adjusted based on the antenna design and dimensions. In an embodiment, electromagnetic simulations can be used to visualize current flowing through the antenna 900. The gap 912 can then be increased or decreased until the simulation shows that current no longer is being reflected and flowing back through the transmitter. The canceling of common mode current can be visualized as the point where current stops flowing in one direction, into the transmitter, and starts flowing in an opposite direction, with one direction flowing into the antenna 900 and a second direction flowing out of the antenna 900.

The tapered sides 914 of the balun 910 serve the purpose of electrically coupling. The angle of the tapered sides 914 can be adjusted to impedance match the antenna 900. Typically individual inductors and individual capacitors are placed along the feed line (not shown) to the antenna 900 to match the impedance of the device feeding the antenna 900 to the impedance of the antenna 900. For example, if an antenna expects an input of 50 ohms, but the circuitry of the device is feeding 150 ohms to the antenna, then a series of inductors and capacitors are used to balance this mismatch problem by transforming the 150 ohms being fed to the antenna to the 50 ohms expected by the antenna. In contrast to these common practices in industry, embodiments of the self-contained antenna 900 need not be impedance matched via any external components, such as by using a series of inductors and capacitors along the line feeding the antenna 900. Instead, the balun 910 is used to match the impedance of the antenna 900 to the connector feeding the antenna 900 and to match the impedance of the magnetic loop 902.

Figure 9B:
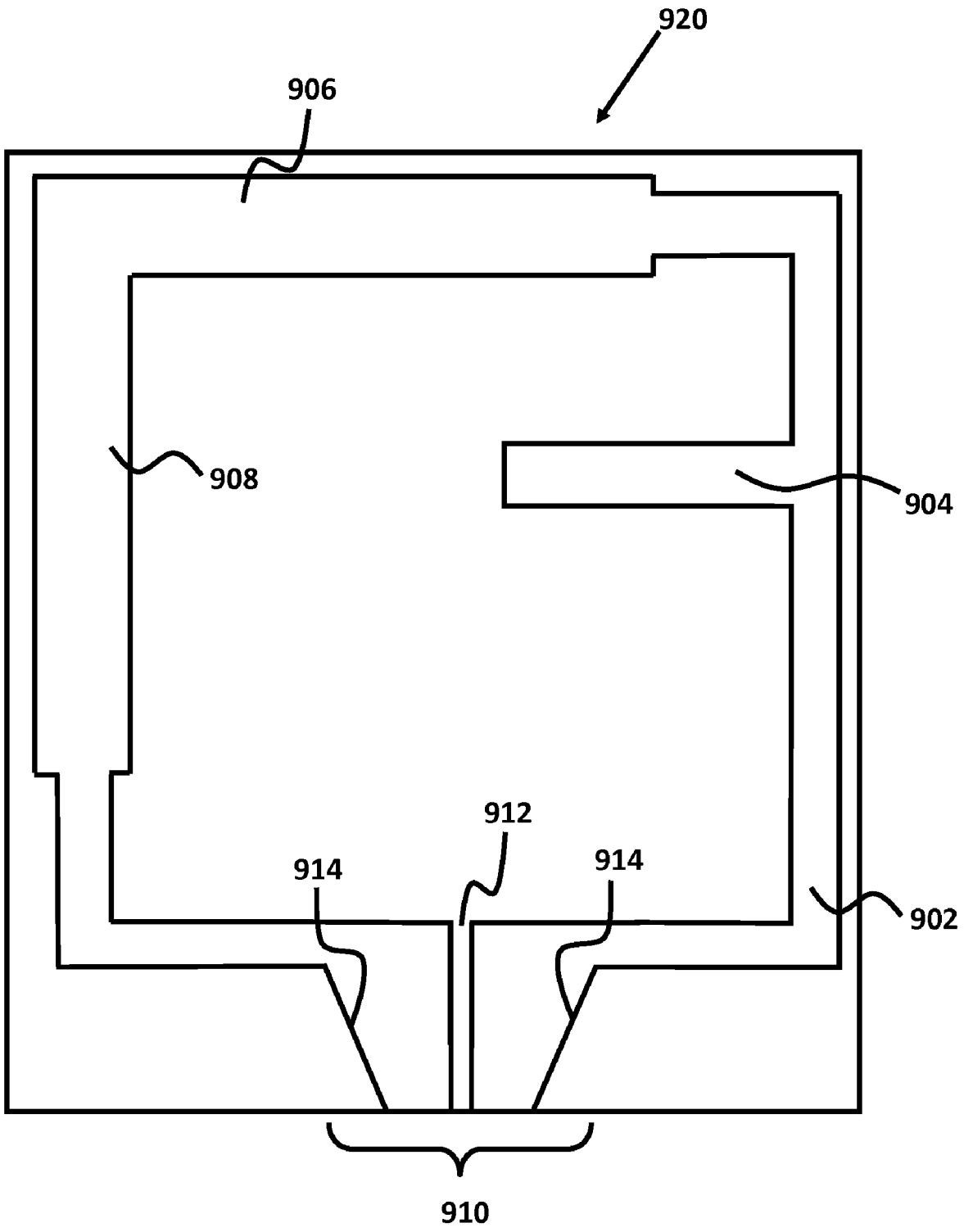
FIG. 9B illustrates an alternative embodiment of the antenna from FIG. 9A with the balun pulled down.

The height of the balun 910 is a function of the frequency of operation of the antenna 900. Therefore, a taller balun 910 is needed for lower frequencies, whereas a shorter balun 910 is needed for higher frequencies. When using a tall balun in an antenna, the proximity of the balun 910 to the electric field radiator(s) is important. Positioning the balun 910 too close to the electric field radiator 904 can create capacitive coupling between the balun 910 and the electric field radiator 904. Therefore, it is important for the balun 910 to be appropriately spaced from the electric field radiator 904 to prevent capacitive coupling from affecting the antenna 900 performance. If a particular antenna design requires the use of a tall balun due to the frequency of operation of the antenna, to properly impedance match the antenna and to cancel common mode current, then the balun can be moved down, as illustrated in antenna 920 in FIG. 9B. In an alternative embodiment, the self-contained counterpoise antenna 900 may not include the balun 910.

The antenna 900 is an example of a self-contained counterpoise compound field antenna. Embodiments of the antenna 900 can be printed or otherwise deposited on an approximately 1.6 millimeter FR-4 substrate. The properties and design of the antenna 900 also make it adaptable to other materials, including flexible printed circuits, Acrylonitrile butadiene styrene (ABS) plastic, and even materials not seen as suitable for microwave frequencies. The frequency of operation of the antenna 900 is approximately 2300 to 2700 MHz, making it suitable for a variety of embedded applications including mobile phones, access points, PDAs, laptops, PC-Cards, sensors, and automotive applications. Embodiments of the antenna 900 have achieved a peak efficiency of approximately 94% and a peak gain of approximately +3 dBi. The antenna 900 has a width of approximately 31 millimeters and a length of approximately 31 millimeters. The antenna 900 has a linear polarization and an impedance of approximately 50 ohm. The antenna 900 also has a voltage standing wave ratio of less than two to one (<2:1). The size and efficiency of the antenna 900 makes it suitable for Wi-Fi applications where efficiency, size, and gain are important.

Figure 10A:
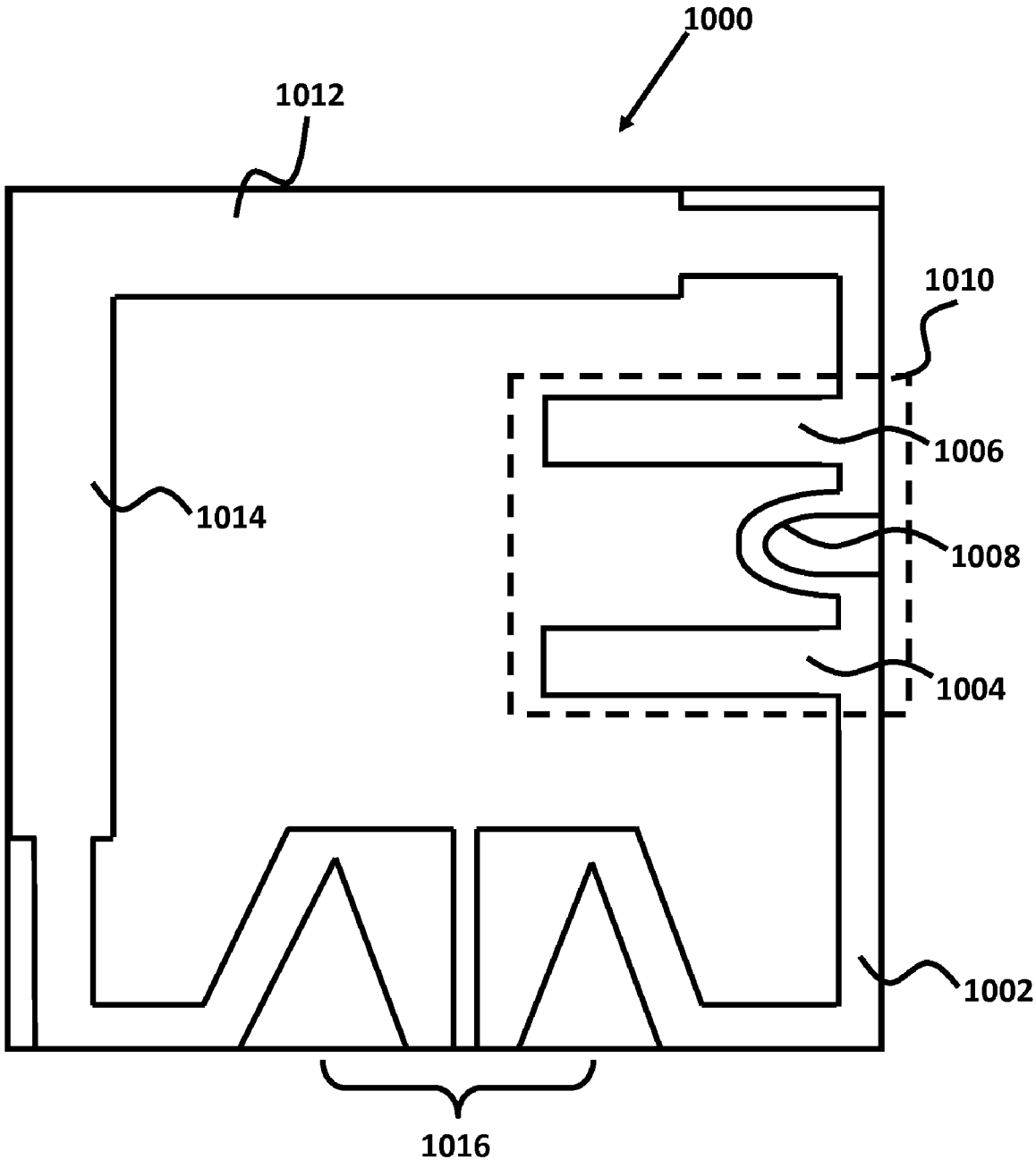
FIG. 10A illustrates an embodiment of a self-contained counterpoise antenna with an array of electric field radiators and a curved trace between the electric field radiators.

An alternative embodiment of a single-sided antenna with a built-in counterpoise is illustrated in FIG. 10A. Antenna 1000 is an example of an antenna with a linear polarization. The antenna does not require a ground plane due to the built-in counterpoise. The antenna 1000 can be printed or otherwise deposited on a 1.6 millimeter thick FR-4 substrate. Similarly to the antenna 900, the properties and design of the antenna 1000 make it adaptable to other materials, including flexible printed circuits, Acrylonitrile butadiene styrene (ABS) plastic, and even materials not seen as suitable for microwave frequencies. The antenna 1000 operates at a frequency range of about 882 MHz to 948 MHz, with a measured peak gain of about +3 dBi and a peak efficiency of about 92%. The antenna 1000 has an antenna impedance of about 50 ohm and a voltage standing wave ratio of less than two to one (<2:1). The antenna 1000 has a width of about 76 millimeters and a height of about 76 millimeters.

The antenna 1000 consists of a magnetic loop 1002, with a first electric field radiator 1004 directly coupled to the magnetic loop 1002 and a second electric field radiator 1006 directly coupled to the magnetic loop 1002. Both of the electric field radiators 1004 and 1006 are coupled to the magnetic loop 1002 without the benefit of an electrical trace. The electric field radiators 1004 and 1006 are physically located on the inside of the magnetic loop 1002. The use of two electric field radiators, instead of one as in antenna 900 in FIG. 9, increases the gain of the antenna. The curved line 1008 separating the two electric field radiators 1004 and 1006 serves the function of delaying the phase between the two electric field radiators 1004 and 1006 in order to make their farfield patterns additive.

Figure 10B:
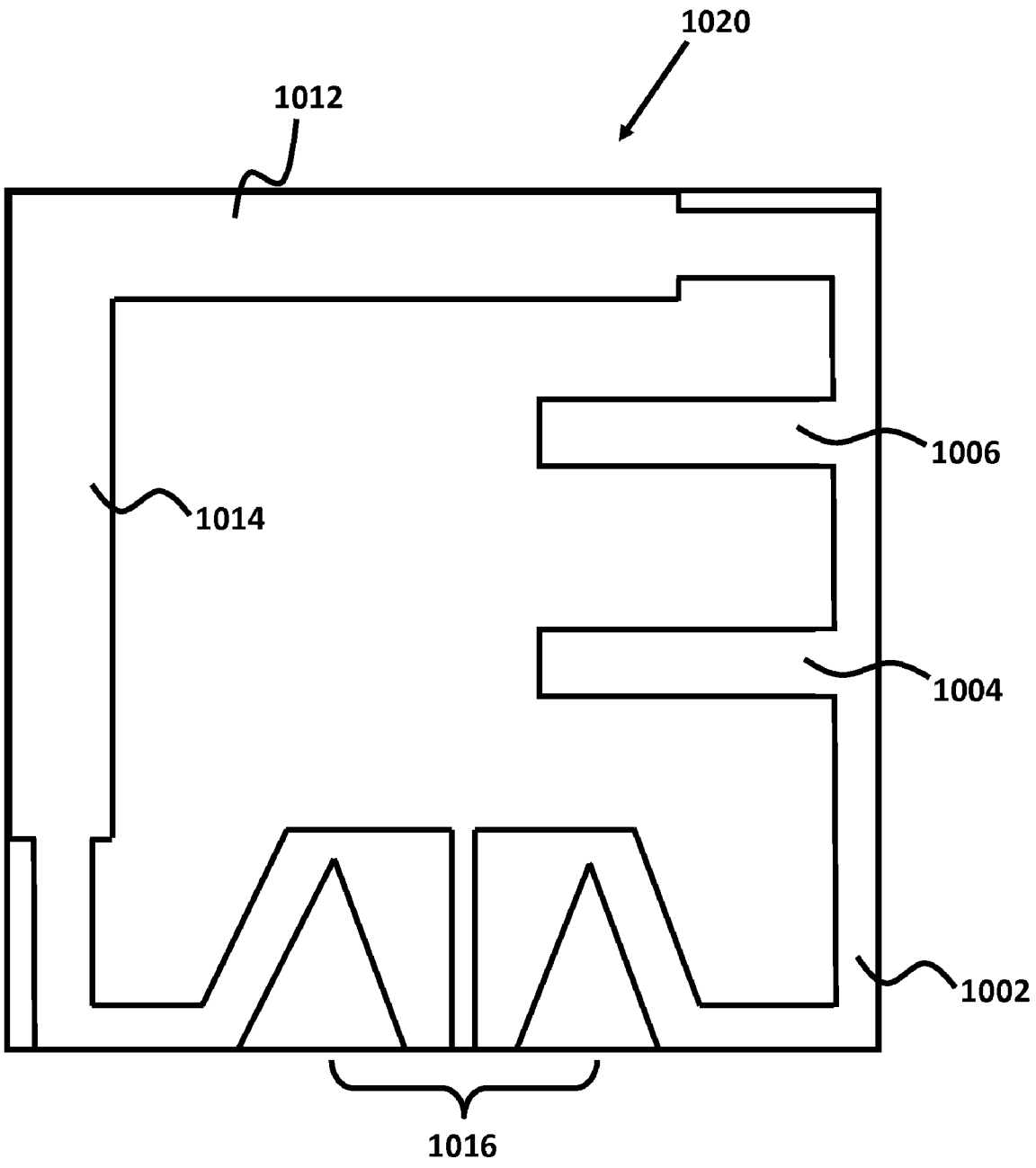
FIG. 10B illustrates an embodiment of a self-contained counterpoise antenna with an array of electric field radiators, but without the curved trace.

The two electric field radiators 1004 and 1006 together with the curved line 1008 create an electric field radiator array 1010 with phase delay. Specifically, the curved line 1008 ensures that the two electric field radiators 1004 and 1006 are 180 degrees out of phase with each other. The curved line can be used as a space saving technique. For instance, if a small antenna is needed, forcing the two electric field radiators to be closer together due to the need to minimize size, then the curved line 1008 can be used to ensure that the electric field radiators are still 180 degrees out of phase with each other. The electrical length of the trace of the curved line 1008 can be adjusted as necessary based on the needed delay. For example, the trace can be made longer or shorter while keeping the width constant. Alternatively, the length of the trace can be kept constant while the width of the trace is made wider or thicker. As described above, the electrical length of a trace is dependent on its physical length and its physical width. FIG. 10B illustrates an alternative embodiment of a self-contained antenna 1020 without the curved line 1008.

As discussed in reference to antenna 900, the antenna transition 1012 and the counterpoise 1014 can be adjusted accordingly based on a number of factors. The transition 1012 is dependent on the frequency of operation, but it must also be long enough to ensure that the counterpoise 1014 is electrically isolated. A counterpoise 1014 that is large as possible is preferable. Finally, the balun 1016 cancels common mode current and matches the impedance of the antenna 1000 to the impedance of the transmitter feeding the antenna 1000.

In an alternative embodiment of the antenna 1000, the electric field radiator array 1010 can be arranged on the left side of the antenna 1000 instead of on the right side. In such an alternative embodiment, the counterpoise 1014 would be positioned on the upper right side of the magnetic loop 1002. The counterpoise 1014 could also be positioned along the right side of the magnetic loop 1002, directly below the electric field radiators 1004 and 1006.

Figure 11A:
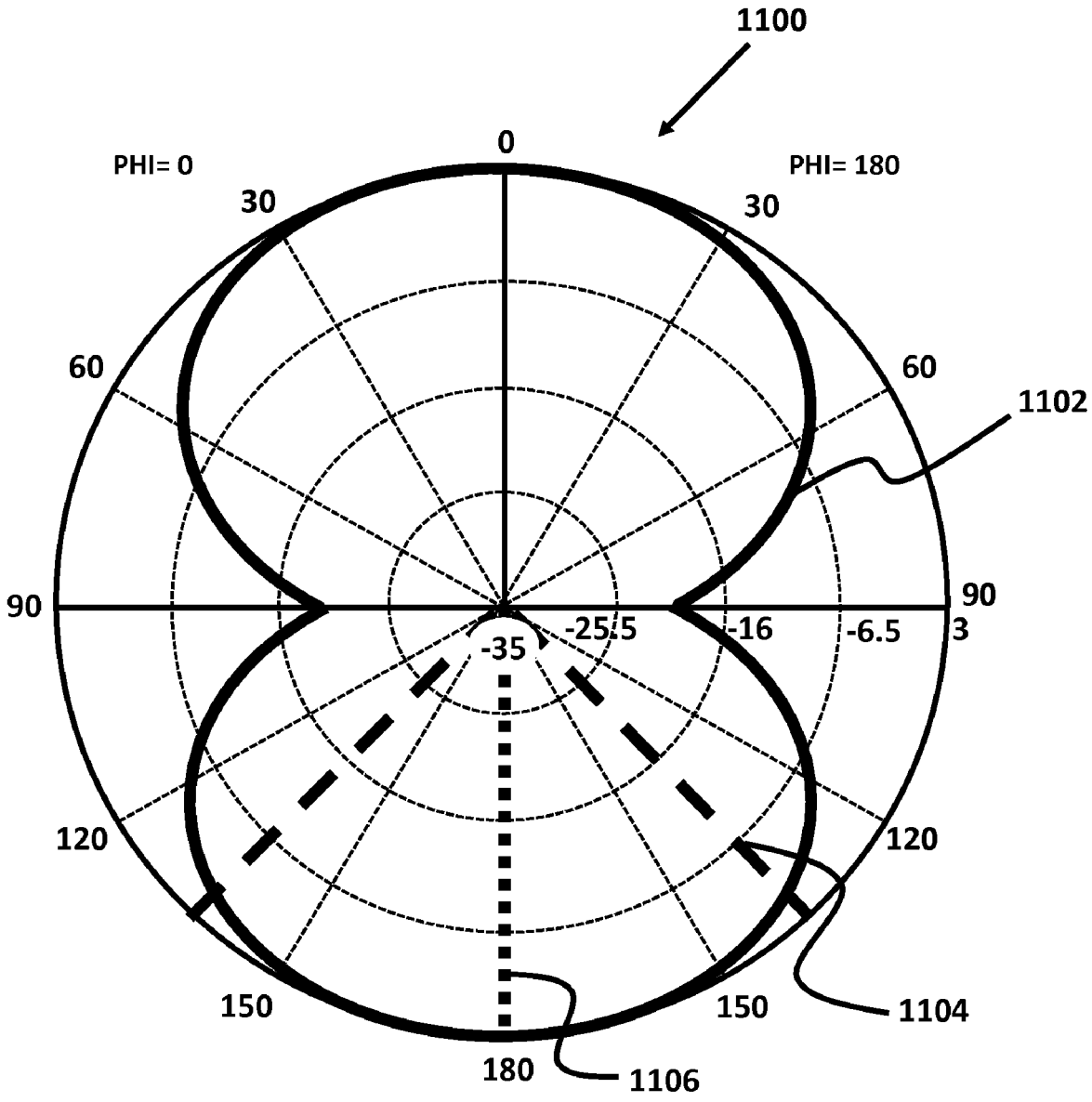
FIGS. 11A-11C approximately illustrate the 2D radiation patterns for the antenna from FIG. 9.
Figure 11B:
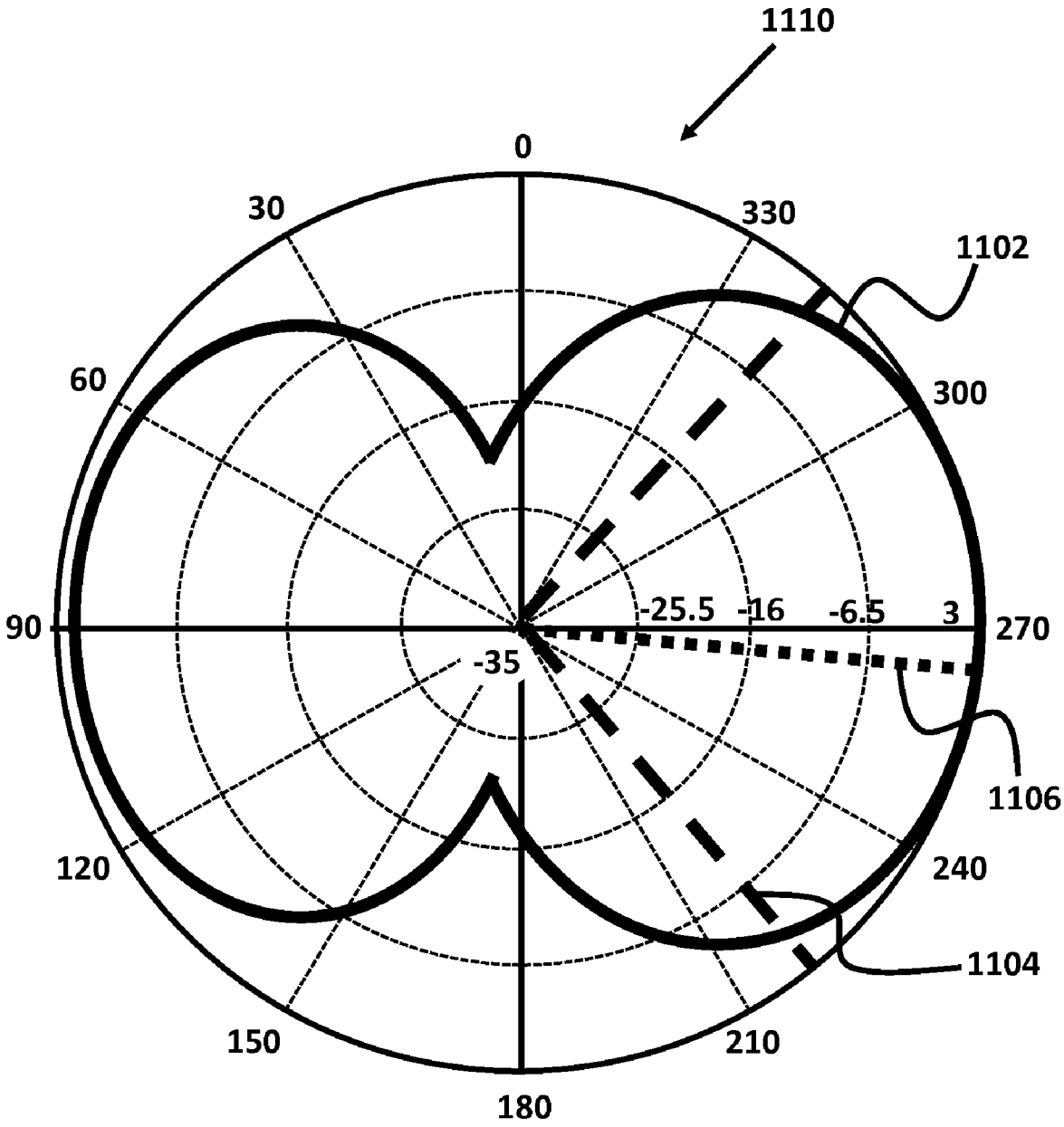
Figure 11C:
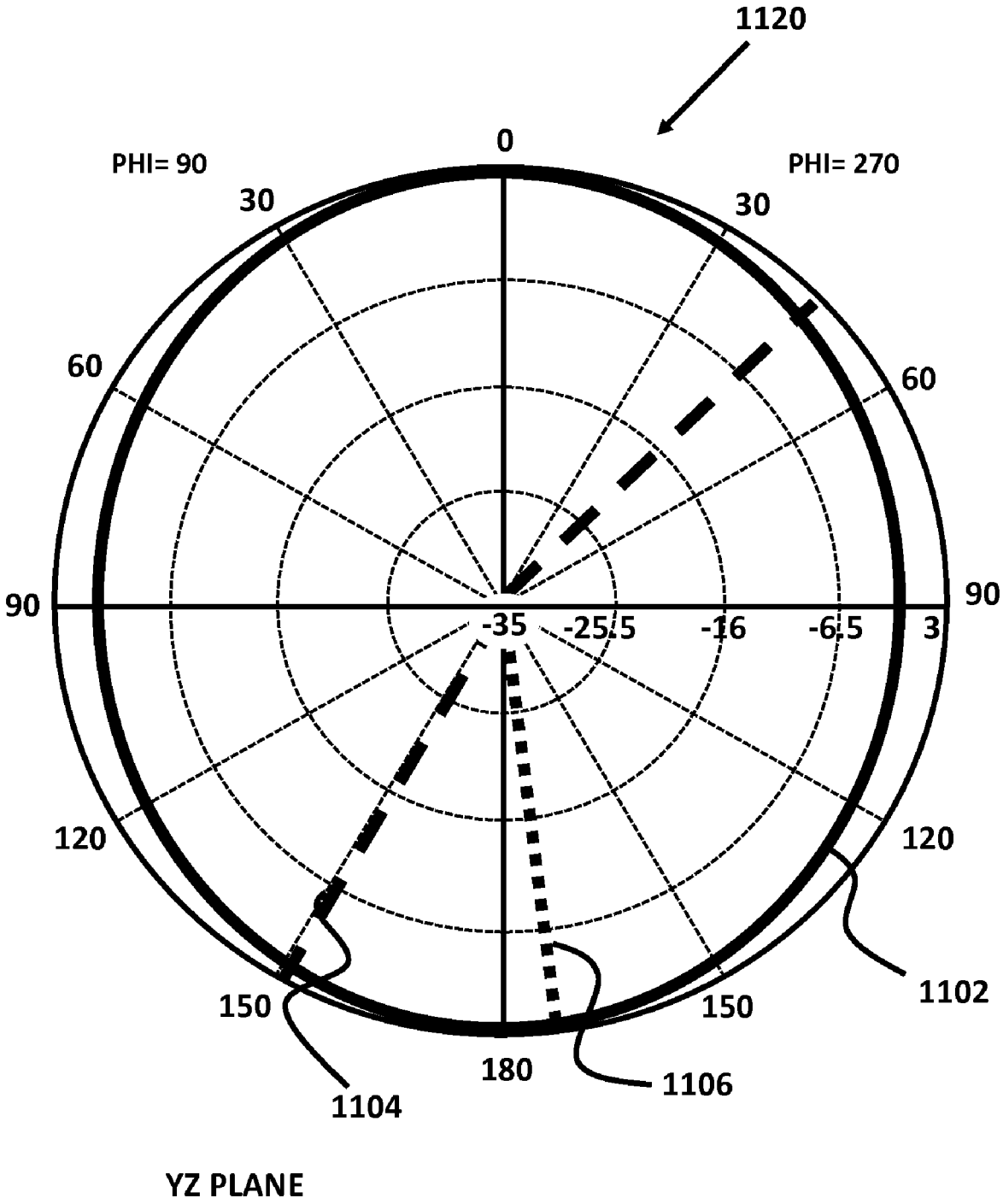

FIGS. 11A-11C illustrate the 2D radiation patterns for the antenna 900 from FIG. 9. FIG. 11A illustrates the 2D radiation pattern on the XZ plane 1100. Solid line 1102 represents the actual radiation pattern, dashed line 1104 represents the 3 dB beamwidth, and dotted line 1106 represents the maximum strength of the field along one direction, that is, line 1106 represents where in the illustrated 2D radiation pattern the strongest field was detected. FIG. 11B illustrates the 2D radiation pattern for the antenna 900 on the XY plane 1110, and FIG. 11C illustrates the 2D radiation pattern for the antenna 900 on the YZ plane 1120.

Figure 12A:
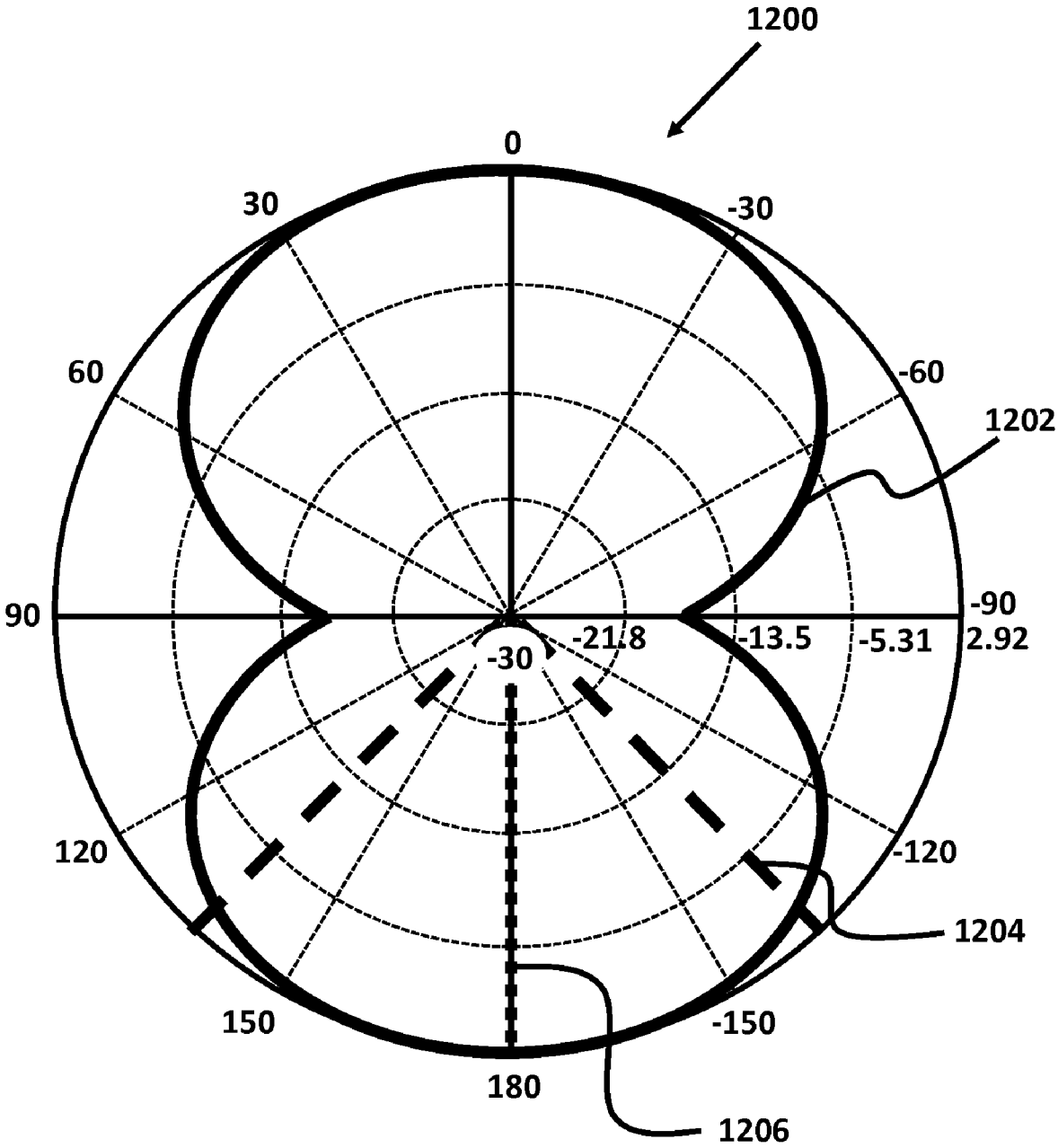
FIGS. 12A-12C approximately illustrate the 2D radiation patterns for the antenna from FIG. 10A.
Figure 12B:
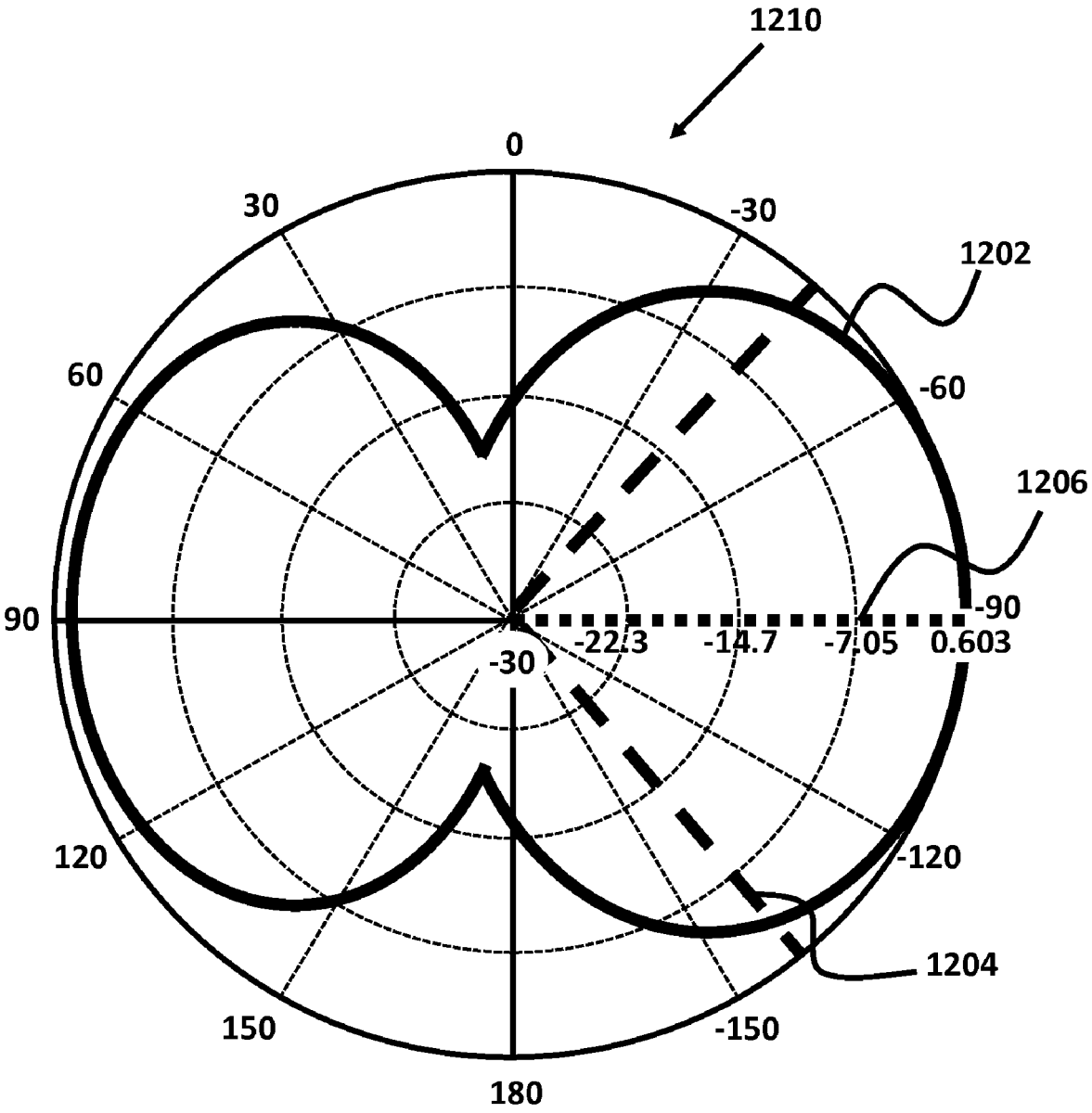
Figure 12C:
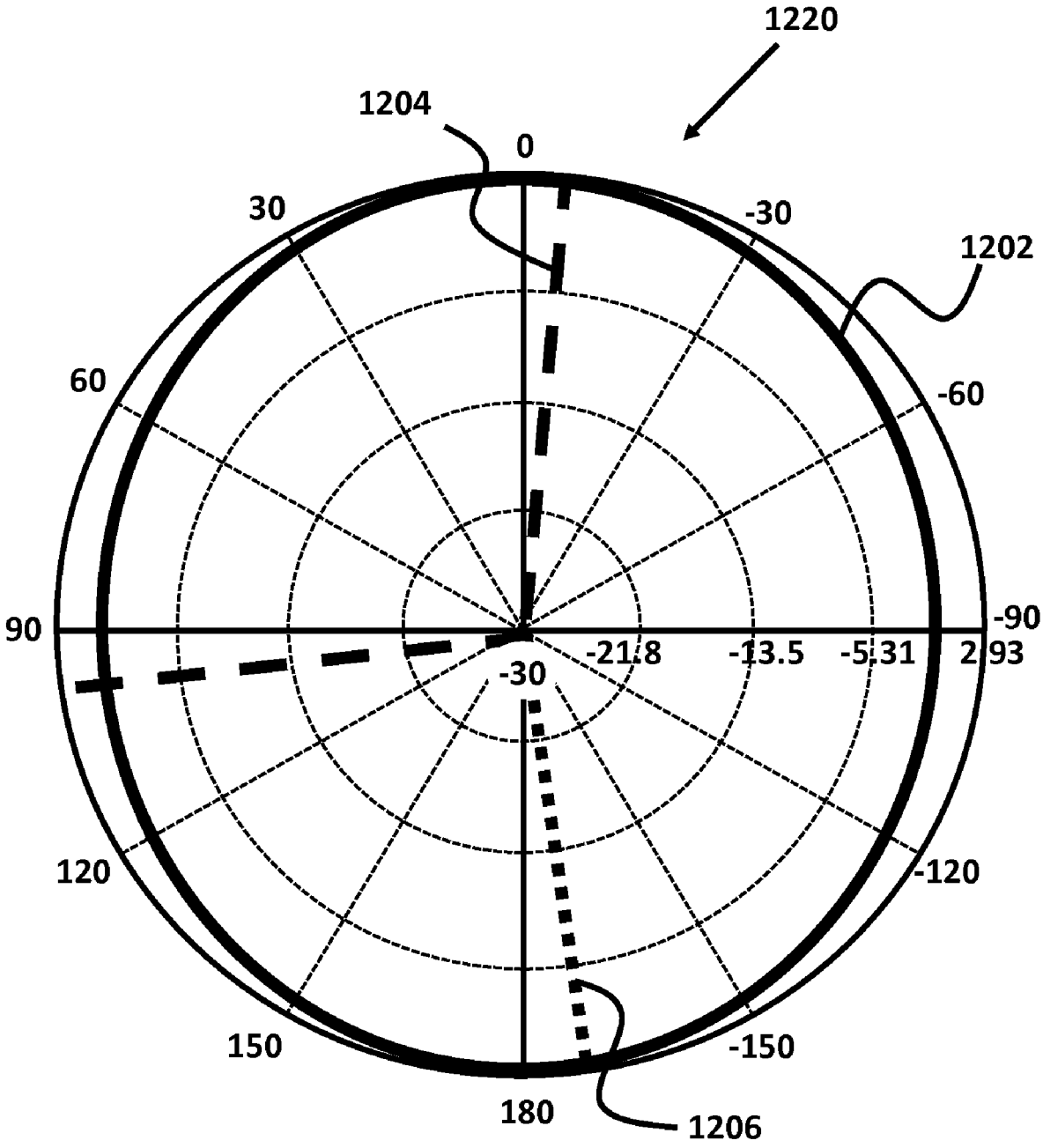

FIGS. 12A-12C illustrate the 2D radiation patterns for the antenna 1000 from FIG. 10A. FIG. 12A illustrates the 2D radiation pattern on the XZ plane 1200. Solid line 1202 represents the actual radiation pattern, dashed line 1204 represents the 3 dB beamwidth, and dotted line 1206 represents the maximum strength of the field along one direction, that is, line 1206 represents where in the illustrated 2D radiation pattern the strongest field was detected. FIG. 12B illustrates the 2D radiation pattern for the antenna 1000 on the XY plane 1210, and FIG. 12C illustrates the 2D radiation pattern for the antenna 1000 on the YZ plane 1220.

Figure 13A:
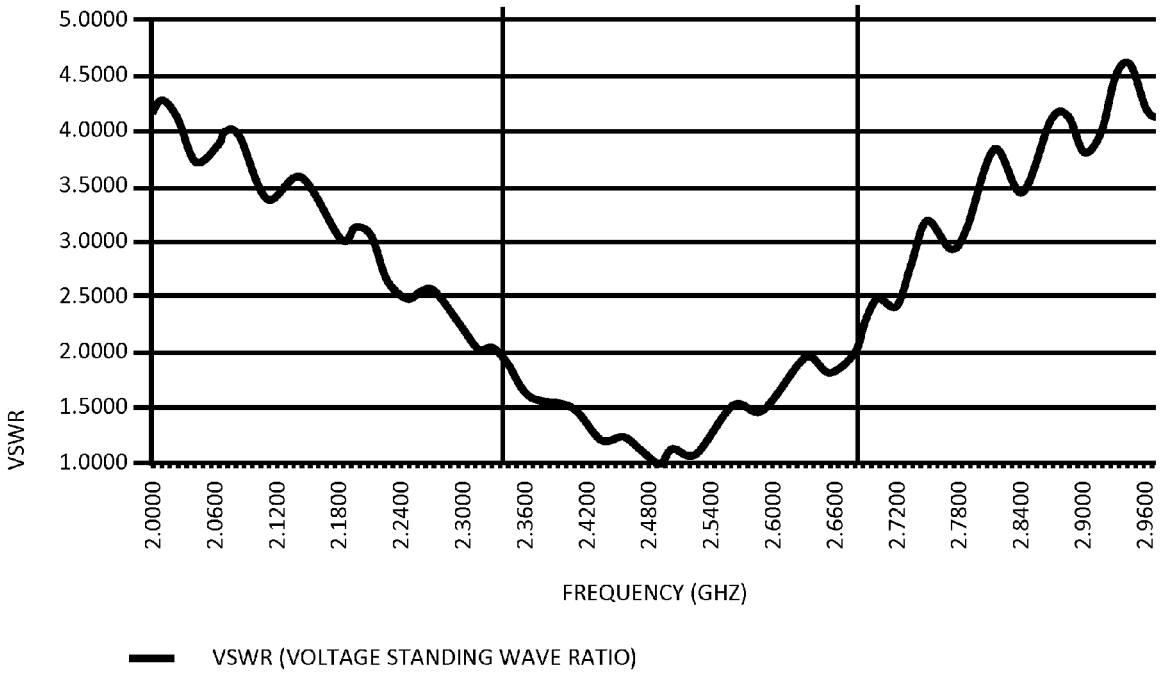
FIG. 13A approximately illustrates a plot of the voltage standing wave ratio for the antenna from FIG. 9.
Figure 13B:
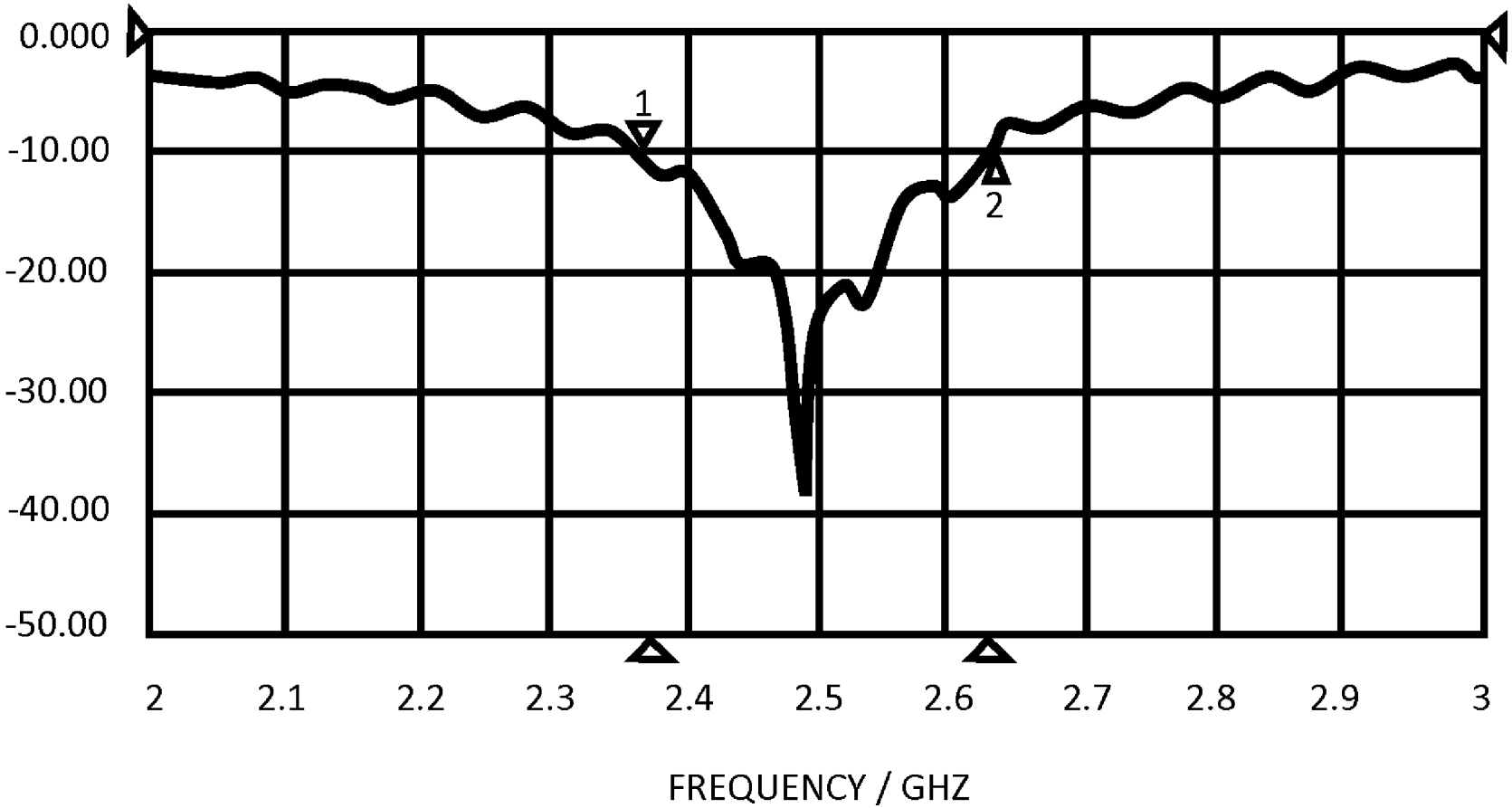
FIG. 13B approximately illustrates a plot of the measured return loss for the antenna from FIG. 9.

FIG. 13A illustrates the voltage standing wave ratio (VSWR) for the antenna 900. The VSWR plot shows that for the frequency range of approximately 2.34 GHz to approximately 2.69 GHz, the antenna 900 is a good impedance match. That is, over approximately the 2.34 GHz to 2.69 GHz frequency range most of the energy fed into antenna 900 will be radiated out, rather than being reflected back into the transmitter. Specifically, inside the two central vertical solid lines represents the frequency range where the VSWR of antenna 900 is less than two to one (<2:1). FIG. 13B illustrates the return loss for antenna 900. Return loss and VSWR are mathematically related, such that −10.0 return loss on FIG. 13B corresponds to 2.0 in VSWR on FIG. 13A. The return loss diagram from FIG. 13B shows that between points labeled 1 and 2, the antenna 900 is a good impedance match.

Figure 14A:
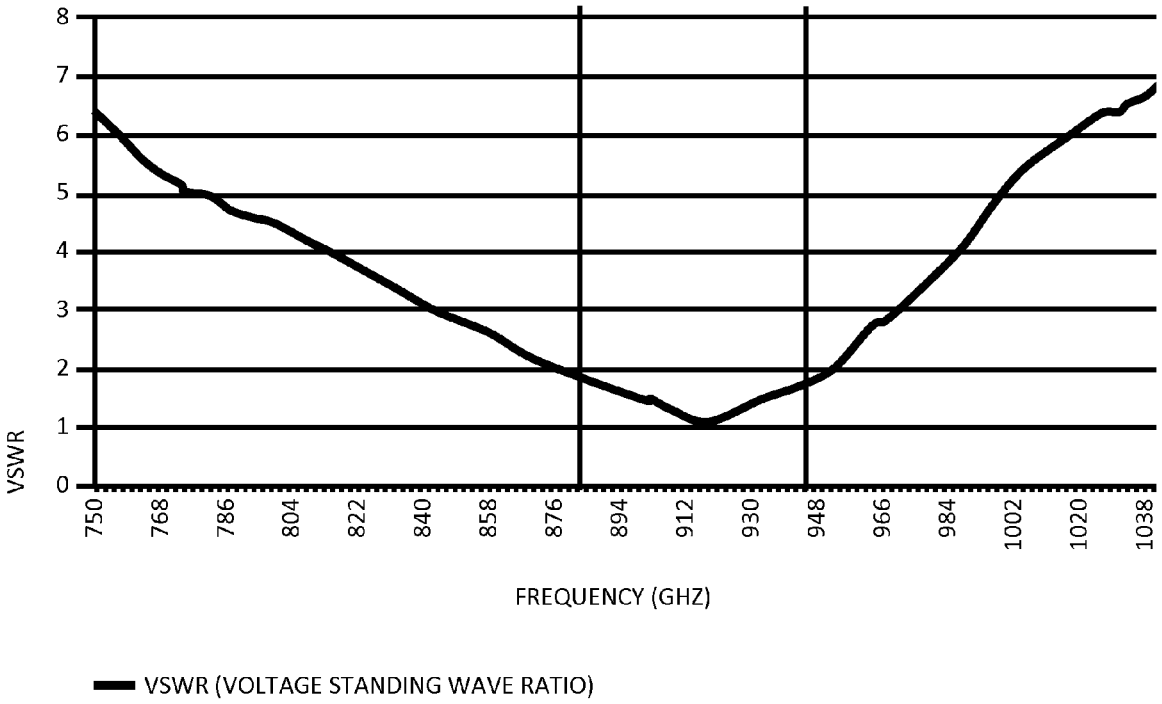
FIG. 14A approximately illustrates a plot of the voltage standing wave ratio for the antenna from FIG. 10.
Figure 14B:
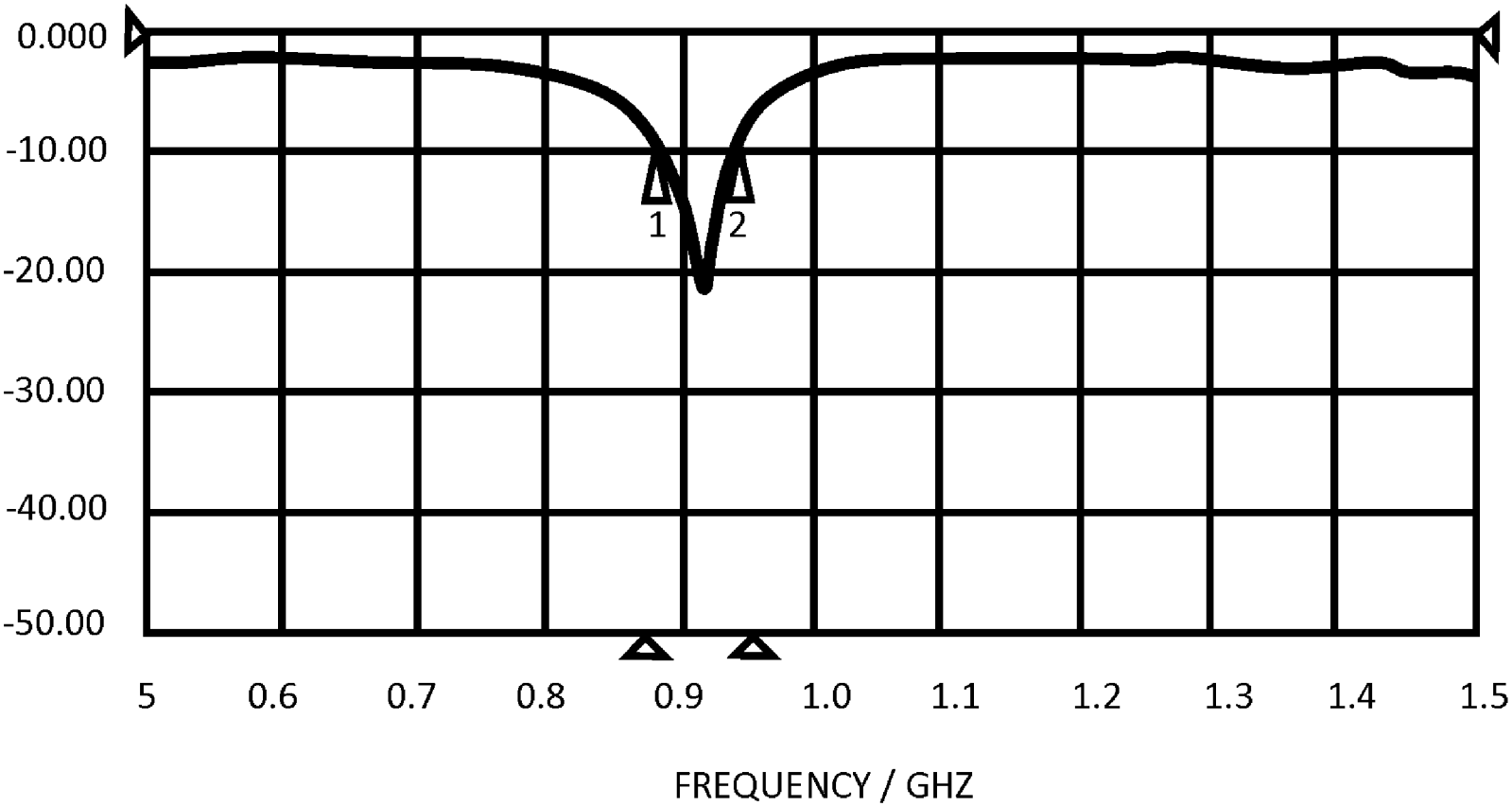
FIG. 14B approximately illustrates a plot of the measured return loss for the antenna from FIG. 10.

FIG. 14A illustrates the voltage standing wave ratio (VSWR) for the antenna 1000 from FIG. 10A. The VSWR plot shows that for the frequency range of approximately 884 MHz to approximately 947 MHz, the antenna 1000 is a good impedance match. That is, over approximately the 884 MHz to 947 MHz frequency range most of the energy fed into the antenna 1000 will be radiated out, rather than being reflected back into the transmitter. Specifically, inside the two central vertical solid lines represents the frequency range where the VSWR of antenna 1000 is less than two to one (<2:1). FIG. 14B illustrates the return loss for antenna 1000. As previously stated, −10.0 return loss corresponds to 2.0 in VSWR. The return loss diagram from FIG. 14B shows that between points labeled 1 and 2, the antenna 1000 is a good impedance match.

Figure 15:
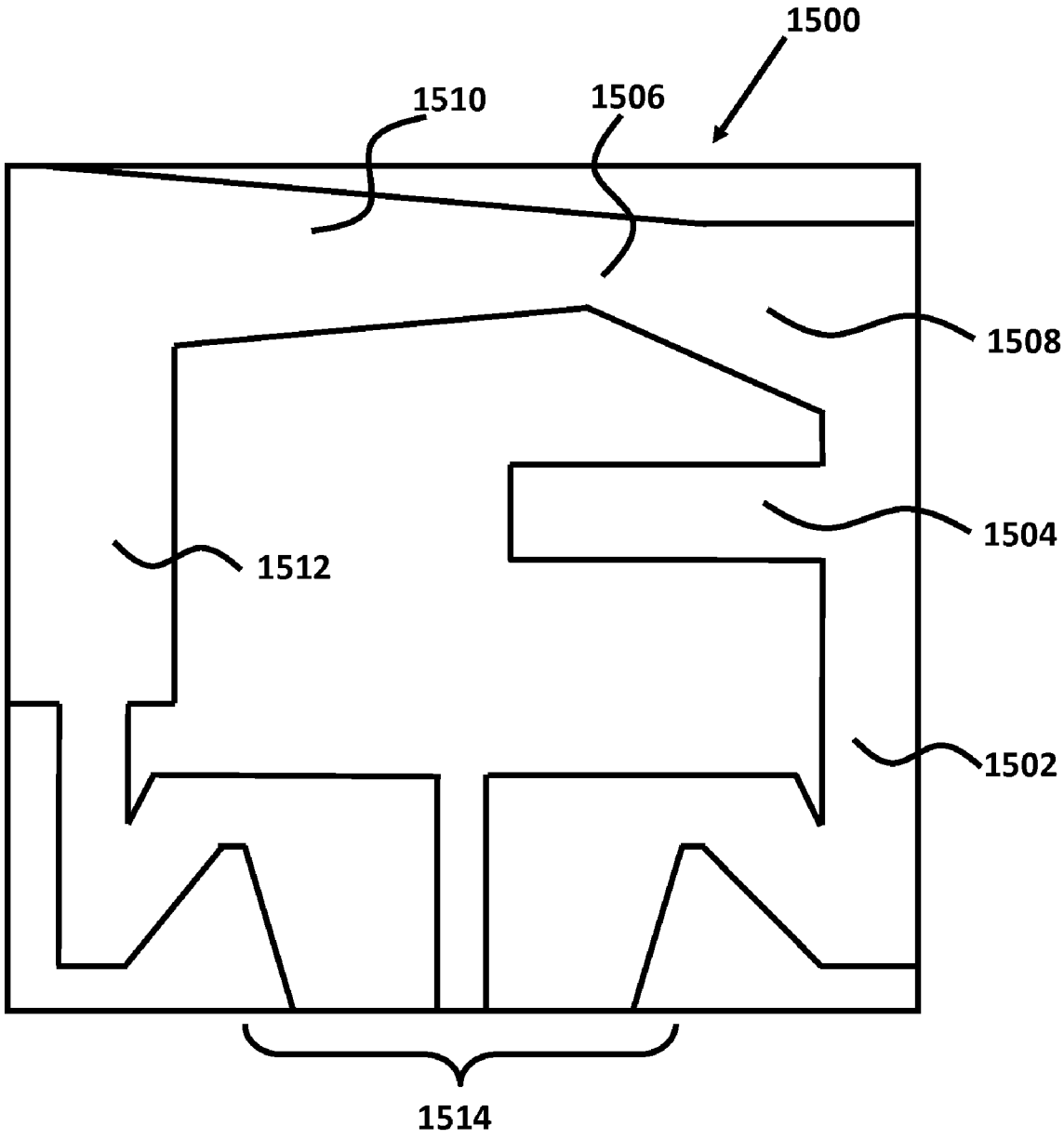
FIG. 15 approximately illustrates an embodiment of a self-contained counterpoise antenna with tapered transitions.

FIG. 15 illustrates yet another embodiment of a self-contained antenna 1500. The antenna 1500 is an example of a 5.8 GHz antenna. The particular embodiment of antenna 1500 has dimensions of length of approximately 15 millimeters and a width of approximately 15 millimeters. The antenna 1500 consists of a magnetic loop 1502, with an electric field radiator 1504 directly coupled to the magnetic loop 1502. In contrast to self-contained antenna 900 and 1000, the antenna 1500 includes a tapered transition 1506 consisting of two sections 1508 and 1510. The first transition section 1508 begins where the width of the magnetic loop changes from a small width to a large width. The first transition section 1508 tapers linearly towards a smaller width before the width of the magnetic loop is increased again where the second transition section 1510 begins. The second transition section tapers linearly from a small width to a larger width. As previously discussed, adjusting the width of the trace of the magnetic loop allows for the electrical length of the magnetic loop to be adjusted. In addition, the length, width, and the number of transitions used electrically isolates the counterpoise 1512. The transition 1506 must be long enough so that the current flowing through the counterpoise 1512 is minimal in magnitude. In addition, tapering the transition 1506 to the counterpoise 1512 increases the bandwidth in terms of the impedance match. The balun 1514 cancels common mode current and it matches the impedance of the antenna 1500. Alternative embodiments of the antenna 1500 may not include the balun 1514.

An embodiment consists of a single-sided antenna, comprising a magnetic loop having a width located on a plane generating a magnetic field and having a first inductive reactance; an electric field radiator located on the plane emitting an electric field and having a first capacitive reactance, the electric field radiator directly coupled to the magnetic loop, wherein the electric field is orthogonal to the magnetic field, and wherein a physical arrangement between the electric field radiator and the magnetic loop results in a second capacitive reactance; a transition formed on the magnetic loop and having a transition width greater than the width; and a counterpoise formed on the magnetic loop positioned along the magnetic loop opposite or adjacent the electric field radiator, wherein the transition substantially electrically isolates the counterpoise from the magnetic loop.

An embodiment consists of a single-sided antenna, comprising a magnetic loop having a width located on a plane generating a magnetic field and having a first inductive reactance; an electric field radiator located on the plane emitting an electric field and having a first capacitive reactance, the electric field radiator directly coupled to the magnetic loop, wherein the electric field is orthogonal to the magnetic field, and wherein a physical arrangement between the electric field radiator and the magnetic loop results in a second capacitive reactance; a transition formed on the magnetic loop and having a transition width greater than the width; and a counterpoise formed on the magnetic loop positioned along the magnetic loop opposite or adjacent the electric field radiator, wherein the transition substantially electrically isolates the counterpoise from the magnetic loop.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

While the present invention has been illustrated and described herein in terms of several alternatives, it is to be understood that the techniques described herein can have a multitude of additional uses and applications. Accordingly, the invention should not be limited to just the particular description, embodiments and various drawing figures contained in this specification that merely illustrate a preferred embodiment, alternatives and application of the principles of the invention.

What is claimed is:

1. A single-layer antenna, comprising:

a magnetic loop located on a plane and configured to generate a magnetic field, wherein the magnetic loop has a first inductive reactance adding to a total inductive reactance of the single-layer antenna;

an electric field radiator located on the plane and within the magnetic loop, the electric field radiator coupled to the magnetic loop and configured to emit an electric field orthogonal to the magnetic field, wherein the electric field radiator has a first capacitive reactance adding to a total capacitive reactance of the single-layer antenna, wherein a physical arrangement between the electric field radiator and the magnetic loop results in a second capacitive reactance adding to the total capacitive reactance, and wherein the total inductive reactance substantially matches the total capacitive reactance;

a transition formed on the magnetic loop, wherein a width of the transition is greater than a width of the magnetic loop; and a counterpoise formed on the magnetic loop and positioned substantially 180 degrees out of phase with the electric field radiator, wherein the transition is configured to substantially electrically isolate the counterpoise from the magnetic loop.

2. The single-layer antenna as recited in claim 1, further comprising a balun configured to cancel a common mode current and tune the single-layer antenna to a desired input impedance.

3. The single-layer antenna as recited in claim 2, wherein the balun is substantially triangular shaped, and wherein a height of the triangular shape is based on a frequency of operation of the single-layer antenna.

4. The single-layer antenna as recited in claim 2, wherein a position of the balun is selected from the group consisting of a position within the magnetic loop and a position outside the magnetic loop.

5. The single-layer antenna as recited in claim 1, wherein the counterpoise has a counterpoise width greater than the width of the magnetic loop.

6. The single-layer antenna as recited in claim 1, wherein the transition is further comprised of a first section and a second section, wherein the first section linearly tapers from the width of the magnetic loop to the width of the transition, and wherein the second section linearly tapers from the width of the transition to a width of the counterpoise.

7. The single-layer antenna as recited in claim 1, further comprising an electrical trace coupling the electric field radiator to the magnetic loop, wherein the electrical trace has a shape selected from the group consisting of a substantially smooth curve and a shape minimizing a number of bends in the electrical trace, and wherein the electrical trace has a second inductive reactance adding to the total inductive reactance.

8. The single-layer antenna as recited in claim 7, wherein the electrical trace couples the electric field radiator to the magnetic loop at an electrical degree location approximately 90 degrees or approximately 270 degrees from a drive point of the magnetic loop.

9. The single-layer antenna as recited in claim 7, wherein the electrical trace couples the electric field radiator to the magnetic loop at a reflective minimum point where a current flowing through the magnetic loop is at a reflective minimum.

10. The single-layer antenna as recited in claim 7, wherein the electrical trace is configured to electrically lengthen the electric field radiator.

11. The single-layer antenna as recited in claim 1, wherein the electric field radiator is directly coupled to the magnetic loop at an electrical degree location approximately 90 degrees or approximately 270 degrees from a drive point of the magnetic loop.

12. The single-layer antenna as recited in claim 1, wherein the electric field radiator is directly coupled to the magnetic loop at a reflective minimum point where a current flowing through the magnetic loop is at a reflective minimum.

13. The single-layer antenna as recited in claim 1, wherein the electric field radiator has an electrical length appropriate to generate a resonance at a center frequency of operation of the single-layer antenna.

14. The single-layer antenna as recited in claim 1, wherein a current flowing through the magnetic loop flows into the electric field radiator and the current is reflected along an opposite direction into the magnetic loop creating the electric field orthogonal to the magnetic field.

15. The single-layer antenna as recited in claim 1, wherein the magnetic loop has a shape selected from the group consisting of a substantially circular shape, a substantially ellipsoid shape, a substantially rectangular shape, and a substantially polygonal shape.

16. The single-layer antenna as recited in claim 15, wherein the substantially rectangular shape and the substantially polygonal shape of the magnetic loop has one or more corners cut at an angle.

17. The single-layer antenna as recited in claim 1, wherein the magnetic loop is formed from a plurality of sections continuously connected, wherein at least one segment from the plurality of segments is formed by a first segment having a first width, a middle segment having a middle width, and a second segment having a second width, wherein a first end of the first segment is connected to and adjacent to a first end of the middle segment, wherein a second end of the middle segment is connected and adjacent to a first end of the second segment, and wherein the first width and the second width are different from the middle width.

18. The single-layer antenna as recited in claim 1, wherein at least one segment from the first segment, the middle segment, and the second segment is tapered.

19. The single-layer antenna as recited in claim 1, further comprising a second electric field radiator located on the plane and within the magnetic loop, the second electric field radiator coupled to the magnetic loop and configured to emit a second electric field orthogonal to the magnetic field, wherein the second electric field radiator has a third capacitive reactance adding to the total capacitive reactance, wherein the second electric field radiator has a second electrical length and is configured to emit the second electric field at a second frequency of operation, wherein a second physical arrangement between the second electric field radiator and the magnetic loop results in a fourth capacitive reactance adding to the total capacitive reactance.

20. The single-layer antenna as recited in claim 19, wherein the second electric field radiator couples to the magnetic loop at a second coupling point substantially 180 degrees out of phase with a first coupling point of the electric field radiator.

21. The single-layer antenna as recited in claim 19, further comprising a trace formed on the magnetic loop between the electric field radiator and the second electric field radiator, wherein the trace is configured to create a substantially 180 phase delay between the electric field radiator and the second electric field radiator.

22. The single-layer antenna as recited in claim 19, wherein the electric field radiator has a first electrical length and is configured to emit the electric field at a first frequency of operation, wherein the second electric field radiator has a second electrical length different than the first electrical length, wherein the second electric field radiator is configured to emit the second electric field at a second frequency of operation.

23. The single-layer antenna as recited in claim 19, further comprising a second electrical trace coupling the second electric field radiator to the magnetic loop.

24. The single-layer antenna as recited in claim 23, wherein the second electrical trace couples the second electric field radiator to the magnetic loop at an electrical degree location approximately 90 degrees or approximately 270 degrees from a drive point of the magnetic loop.

25. The single-layer antenna as recited in claim 23, wherein the second electrical trace couples the second electric field radiator to the magnetic loop at a reflective minimum point where a current flowing through the magnetic loop is at a reflective minimum.

26. The single-layer antenna as recited in claim 19, wherein the second electric field radiator is directly coupled to the magnetic loop at an electrical degree location approximately 90 degrees or approximately 270 degrees from a drive point of the magnetic loop.

27. The single-layer antenna as recited in claim 19, wherein the second electric field radiator is directly coupled to the magnetic loop at a reflective minimum point where a current flowing through the magnetic loop is at a reflective minimum.

28. The single-layer antenna as recited in claim 1, wherein the electric field radiator is substantially J shaped.

* * * * *